US009046838B2

(12) United States Patent
Arai et al.

(10) Patent No.: US 9,046,838 B2
(45) Date of Patent: Jun. 2, 2015

(54) FIXING DEVICE AND IMAGE FORMING APPARATUS

(71) Applicants: Yuji Arai, Kanagawa (JP); Takayuki Seki, Kanagawa (JP); Yoshiki Yamaguchi, Kanagawa (JP); Shuntaroh Tamaki, Kanagawa (JP); Yutaka Ikebuchi, Kanagawa (JP); Kazuya Saito, Kanagawa (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Masaaki Yoshikawa, Tokyo (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP); Hiroshi Yoshinaga, Chiba (JP); Ryuuichi Mimbu, Kanagawa (JP); Takuya Seshita, Kanagawa (JP); Takeshi Yamamoto, Kanagawa (JP); Shuutaroh Yuasa, Kanagawa (JP)

(72) Inventors: Yuji Arai, Kanagawa (JP); Takayuki Seki, Kanagawa (JP); Yoshiki Yamaguchi, Kanagawa (JP);

(Continued)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/014,653

(22) Filed: Aug. 30, 2013

(65) Prior Publication Data

US 2014/0079453 A1 Mar. 20, 2014

(30) Foreign Application Priority Data

Sep. 14, 2012 (JP) ..... 2012-202302
Sep. 14, 2012 (JP) ..... 2012-202616
May 30, 2013 (JP) ..... 2013-114137

(51) Int. Cl.
*G03G 15/20* (2006.01)

(52) U.S. Cl.
CPC ..... *G03G 15/2053* (2013.01); *G03G 15/20* (2013.01)

(58) Field of Classification Search
USPC ..... 399/67, 122, 320, 328, 329, 331, 400; 219/216
See application file for complete search history.

(56) References Cited

U.S. PATENT DOCUMENTS 5,499,089 A * 3/1996 Tsukamoto et al. ..... 399/328
8,139,992 B2 * 3/2012 Pirwitz ..... 399/329

(Continued)

FOREIGN PATENT DOCUMENTS

JP 4-044075 2/1992
JP 8-262903 10/1996

(Continued)

OTHER PUBLICATIONS

U.S. Appl. No. 14/010,823, filed Aug. 27, 2013.

(Continued)

*Primary Examiner* — Francis Gray
(74) *Attorney, Agent, or Firm* — Oblon, McClelland, Maier & Neustadt, L.L.P.

(57) ABSTRACT

A fixing device includes a fixing rotary body and a heater disposed opposite the fixing rotary body. A heat shield is movable in a circumferential direction of the fixing rotary body and interposed between the heater and the fixing rotary body to shield the fixing rotary body from the heater. An overheating suppressor is interposed between the heater and the heat shield to shield the heat shield from the heater. The heat shield includes an intermediate portion spanning in the circumferential direction of the fixing rotary body and movable between a shield position where the intermediate portion is disposed opposite the heater directly and a retracted position where the intermediate portion is disposed opposite the heater via the overheating suppressor.

23 Claims, 14 Drawing Sheets

(72) Inventors: Shuntaroh Tamaki, Kanagawa (JP); Yutaka Ikebuchi, Kanagawa (JP); Kazuya Saito, Kanagawa (JP); Kenji Ishii, Kanagawa (JP); Tadashi Ogawa, Tokyo (JP); Teppei Kawata, Kanagawa (JP); Arinobu Yoshiura, Kanagawa (JP); Toshihiko Shimokawa, Kanagawa (JP); Kensuke Yamaji, Kanagawa (JP); Masaaki Yoshikawa, Tokyo (JP); Hiromasa Takagi, Tokyo (JP); Naoki Iwaya, Tokyo (JP); Takahiro Imada, Kanagawa (JP); Hajime Gotoh, Kanagawa (JP); Akira Suzuki, Tokyo (JP); Hiroshi Yoshinaga, Chiba (JP); Ryuuichi Mimbu, Kanagawa (JP); Takuya Seshita, Kanagawa (JP); Takeshi Yamamoto, Kanagawa (JP); Shuutaroh Yuasa, Kanagawa (JP)

(56) References Cited

U.S. PATENT DOCUMENTS

| | | | | |
|---|---|---|---|---|
| 8,175,509 | B2 * | 5/2012 | Gon | 399/330 |
| 8,355,660 | B2 * | 1/2013 | Nanjo | 399/329 |
| 8,498,561 | B2 * | 7/2013 | Yamaguchi et al. | 399/329 |
| 2007/0292175 | A1 | 12/2007 | Shinshi | |
| 2010/0067929 | A1 | 3/2010 | Seki | |
| 2010/0290822 | A1 * | 11/2010 | Hasegawa et al. | 399/329 |
| 2013/0183072 | A1 * | 7/2013 | Hase et al. | 399/329 |
| 2013/0209124 | A1 | 8/2013 | Saito et al. | |
| 2013/0209147 | A1 | 8/2013 | Ogawa et al. | |
| 2013/0251390 | A1 * | 9/2013 | Ishii et al. | 399/67 |
| 2014/0072355 | A1 * | 3/2014 | Tamaki et al. | 399/329 |
| 2014/0079424 | A1 * | 3/2014 | Ikebuchi et al. | 399/69 |
| 2014/0079453 | A1 * | 3/2014 | Arai et al. | 399/329 |

FOREIGN PATENT DOCUMENTS

| | | |
|---|---|---|
| JP | 2004-264785 | 9/2004 |
| JP | 2005-092080 | 4/2005 |
| JP | 2006-250965 | 9/2006 |
| JP | 2007-334205 | 12/2007 |
| JP | 2008-64930 | 3/2008 |
| JP | 2008-139779 | 6/2008 |
| JP | 2008-175988 | 7/2008 |
| JP | 2010-066583 | 3/2010 |
| JP | 2010-122489 | 6/2010 |
| JP | 2011-48271 | 3/2011 |
| JP | 2012-118225 | 6/2012 |

OTHER PUBLICATIONS

U.S. Appl. No. 14/015,035, filed Aug. 30, 2013.
Office Action issued Dec. 1, 2014 in Japanese Patent Application No. 2013-114137.

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2012-202302, filed on Sep. 14, 2012, 2012-202616, filed on Sep. 14, 2012, and 2013-114137, filed on May 30, 2013, in the Japanese Patent Office, the entire disclosure of each of which is hereby incorporated by reference herein.

BACKGROUND

1. Technical Field

Exemplary aspects of the present invention relate to a fixing device and an image forming apparatus, and more particularly, to a fixing device for fixing an image on a recording medium and an image forming apparatus incorporating the fixing device.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotary body heated by a heater and an opposed body contacting the fixing rotary body to form a nip therebetween through which a recording medium bearing a toner image is conveyed. As the fixing rotary body and the opposed body rotate and convey the recording medium bearing the toner image through the nip, the fixing rotary body heated to a predetermined fixing temperature and the opposed body together heat and melt toner of the toner image, thus fixing the toner image on the recording medium.

Since the recording medium passing through the nip draws heat from the fixing rotary body, a temperature sensor detects the temperature of the fixing rotary body to maintain the fixing rotary body at a desired temperature. However, at each lateral end of the fixing rotary body in an axial direction thereof, the recording medium is not conveyed over the fixing rotary body and therefore does not draw heat from the fixing rotary body. Accordingly, after a plurality of recording media is conveyed through the nip continuously, a non-conveyance span situated at each lateral end of the fixing rotary body may overheat.

To address this circumstance, a plurality of heaters having a plurality of axial spans that corresponds to a plurality of sizes of recording media, respectively, may be disposed opposite the fixing rotary body. One or more of the plurality of heaters is selectively turned on according to the size of a recording medium conveyed through the nip to heat a conveyance span of the fixing rotary body where the recording medium is conveyed and not to heat the non-conveyance span of the fixing rotary body. However, the number of heaters increases as the number of sizes of recording media increases, resulting in increased manufacturing costs and increased space occupied by the heaters.

Alternatively, the fixing device may incorporate a heat shield to shield the non-conveyance span of the fixing rotary body from the heater, thus preventing overheating of the fixing rotary body. However, since the heat shield is exposed to and heated by the heater, the heat shield is subject to thermal deformation that may result in degradation of shielding and interference with the surrounding components.

SUMMARY

This specification describes below an improved fixing device. In one exemplary embodiment, the fixing device includes a fixing rotary body rotatable in a predetermined direction of rotation and a heater disposed opposite and heating the fixing rotary body. An opposed body contacts the fixing rotary body to form a nip therebetween through which a recording medium is conveyed. A heat shield is movable in a circumferential direction of the fixing rotary body and interposed between the heater and the fixing rotary body to shield the fixing rotary body from the heater. The heat shield, not circular in the circumferential direction of the fixing rotary body, extends substantially throughout a conveyance span of the fixing rotary body in an axial direction thereof where the recording medium is conveyed. An overheating suppressor is interposed between the heater and the heat shield to shield the heat shield from the heater. The heat shield includes an intermediate portion spanning in the circumferential direction of the fixing rotary body and movable between a shield position where the intermediate portion is disposed opposite the heater directly and a retracted position where the intermediate portion is disposed opposite the heater via the overheating suppressor.

This specification further describes below an improved fixing device. In one exemplary embodiment, the fixing device includes a fixing rotary body rotatable in a predetermined direction of rotation and a heater disposed opposite and heating the fixing rotary body. An opposed body contacts the fixing rotary body to form a nip therebetween through which a recording medium is conveyed. A heat shield is movable in a circumferential direction of the fixing rotary body and interposed between the heater and the fixing rotary body to shield the fixing rotary body from the heater. The heat shield includes a primary shield portion disposed opposite a lateral end of the fixing rotary body in an axial direction thereof to shield the fixing rotary body from the heater and a recess defined by the primary shield portion in the axial direction of the fixing rotary body to allow light radiated from the heater to irradiate the fixing rotary body.

This specification further describes an improved image forming apparatus. In one exemplary embodiment, the image forming apparatus includes the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
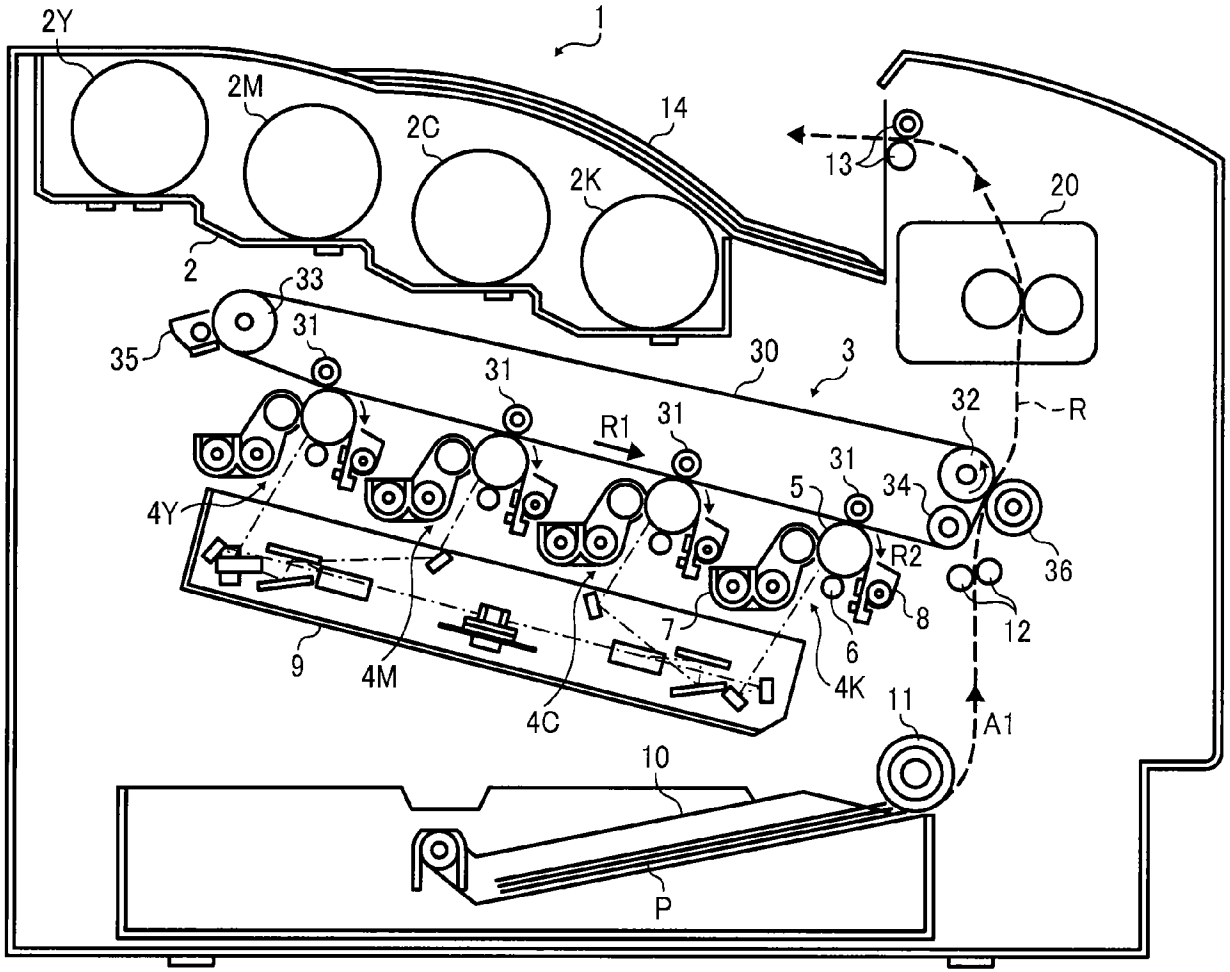
FIG. 1 is a schematic vertical sectional view of an image forming apparatus according to an exemplary embodiment of the present invention.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present invention is explained.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color laser printer that forms color and monochrome toner images on recording media by electrophotography.

As shown in FIG. 1, the image forming apparatus 1 includes four image forming devices 4Y, 4M, 4C, and 4K situated at a center portion thereof. Although the image forming devices 4Y, 4M, 4C, and 4K contain yellow, magenta, cyan, and black developers (e.g., toners) that form yellow, magenta, cyan, and black toner images, respectively, resulting in a color toner image, they have an identical structure.

For example, each of the image forming devices 4Y, 4M, 4C, and 4K includes a drum-shaped photoconductor 5 serving as an image carrier that carries an electrostatic latent image and a resultant toner image; a charger 6 that charges an outer circumferential surface of the photoconductor 5; a development device 7 that supplies toner to the electrostatic latent image formed on the outer circumferential surface of the photoconductor 5, thus visualizing the electrostatic latent image as a toner image; and a cleaner 8 that cleans the outer circumferential surface of the photoconductor 5. It is to be noted that, in FIG. 1, reference numerals are assigned to the photoconductor 5, the charger 6, the development device 7, and the cleaner 8 of the image forming device 4K that forms a black toner image. However, reference numerals for the image forming devices 4Y, 4M, and 4C that form yellow, magenta, and cyan toner images, respectively, are omitted.

Below the image forming devices 4Y, 4M, 4C, and 4K is an exposure device 9 that exposes the outer circumferential surface of the respective photoconductors 5 with laser beams. For example, the exposure device 9, constructed of a light source, a polygon mirror, an f-θ lens, reflection mirrors, and the like, emits a laser beam onto the outer circumferential surface of the respective photoconductors 5 according to image data sent from an external device such as a client computer.

Above the image forming devices 4Y, 4M, 4C, and 4K is a transfer device 3. For example, the transfer device 3 includes an intermediate transfer belt 30 serving as an intermediate transferor, four primary transfer rollers 31 serving as primary transferors, a secondary transfer roller 36 serving as a secondary transferor, a secondary transfer backup roller 32, a cleaning backup roller 33, a tension roller 34, and a belt cleaner 35.

The intermediate transfer belt 30 is an endless belt stretched taut across the secondary transfer backup roller 32, the cleaning backup roller 33, and the tension roller 34. As a driver drives and rotates the secondary transfer backup roller 32 counterclockwise in FIG. 1, the secondary transfer backup roller 32 rotates the intermediate transfer belt 30 in a rotation direction R1 by friction therebetween.

The four primary transfer rollers 31 sandwich the intermediate transfer belt 30 together with the four photoconductors 5, respectively, forming four primary transfer nips between the intermediate transfer belt 30 and the photoconductors 5. The primary transfer rollers 31 are connected to a power supply that applies a predetermined direct current voltage and/or alternating current voltage thereto.

The secondary transfer roller 36 sandwiches the intermediate transfer belt 30 together with the secondary transfer backup roller 32, forming a secondary transfer nip between the secondary transfer roller 36 and the intermediate transfer belt 30. Similar to the primary transfer rollers 31, the secondary transfer roller 36 is connected to the power supply that applies a predetermined direct current voltage and/or alternating current voltage thereto.

The belt cleaner 35 includes a cleaning brush and a cleaning blade that contact an outer circumferential surface of the intermediate transfer belt 30. A waste toner conveyance tube extending from the belt cleaner 35 to an inlet of a waste toner container conveys waste toner collected from the intermediate transfer belt 30 by the belt cleaner 35 to the waste toner container.

A bottle holder 2 situated in an upper portion of the image forming apparatus 1 accommodates four toner bottles 2Y, 2M, 2C, and 2K detachably attached thereto to contain and supply fresh yellow, magenta, cyan, and black toners to the development devices 7 of the image forming devices 4Y, 4M, 4C, and 4K, respectively. For example, the fresh yellow, magenta, cyan, and black toners are supplied from the toner bottles 2Y, 2M, 2C, and 2K to the development devices 7 through toner supply tubes interposed between the toner bottles 2Y, 2M, 2C, and 2K and the development devices 7, respectively.

In a lower portion of the image forming apparatus 1 are a paper tray 10 that loads a plurality of recording media P (e.g., sheets) and a feed roller 11 that picks up and feeds a recording medium P from the paper tray 10 toward the secondary transfer nip formed between the secondary transfer roller 36 and the intermediate transfer belt 30. The recording media P may be thick paper, postcards, envelopes, plain paper, thin paper, coated paper, art paper, tracing paper, OHP (overhead projector) transparencies, OHP film sheets, and the like. Additionally, a bypass tray that loads postcards, envelopes, OHP transparencies, OHP film sheets, and the like may be attached to the image forming apparatus 1.

A conveyance path R extends from the feed roller 11 to an output roller pair 13 to convey the recording medium P picked up from the paper tray 10 onto an outside of the image forming apparatus 1 through the secondary transfer nip. The conveyance path R is provided with a registration roller pair 12 located below the secondary transfer nip formed between the secondary transfer roller 36 and the intermediate transfer belt 30, that is, upstream from the secondary transfer nip in a recording medium conveyance direction A1. The registration roller pair 12 serving as a timing roller pair feeds the recording medium P conveyed from the feed roller 11 toward the secondary transfer nip.

The conveyance path R is further provided with a fixing device 20 located above the secondary transfer nip, that is, downstream from the secondary transfer nip in the recording medium conveyance direction A1. The fixing device 20 fixes a toner image transferred from the intermediate transfer belt 30 onto the recording medium P conveyed from the secondary transfer nip. The conveyance path R is further provided with the output roller pair 13 located above the fixing device 20, that is, downstream from the fixing device 20 in the recording medium conveyance direction A1. The output roller pair 13 discharges the recording medium P bearing the fixed toner image onto the outside of the image forming apparatus 1, that is, an output tray 14 disposed atop the image forming apparatus 1. The output tray 14 stocks the recording medium P discharged by the output roller pair 13.

With reference to FIG. 1, a description is provided of an image forming operation of the image forming apparatus 1 having the structure described above to form a color toner image on a recording medium P.

As a print job starts, a driver drives and rotates the photoconductors 5 of the image forming devices 4Y, 4M, 4C, and 4K, respectively, clockwise in FIG. 1 in a rotation direction R2. The chargers 6 uniformly charge the outer circumferential surface of the respective photoconductors 5 at a predetermined polarity. The exposure device 9 emits laser beams onto the charged outer circumferential surface of the respective photoconductors 5 according to yellow, magenta, cyan, and black image data contained in image data sent from the external device, respectively, thus forming electrostatic latent images thereon. The development devices 7 supply yellow, magenta, cyan, and black toners to the electrostatic latent images formed on the photoconductors 5, visualizing the electrostatic latent images into yellow, magenta, cyan, and black toner images, respectively.

Simultaneously, as the print job starts, the secondary transfer backup roller 32 is driven and rotated counterclockwise in FIG. 1, rotating the intermediate transfer belt 30 in the rotation direction R1 by friction therebetween. The power supply applies a constant voltage or a constant current control voltage having a polarity opposite a polarity of the toner to the primary transfer rollers 31, creating a transfer electric field at each primary transfer nip formed between the photoconductor 5 and the primary transfer roller 31.

When the yellow, magenta, cyan, and black toner images formed on the photoconductors 5 reach the primary transfer nips, respectively, in accordance with rotation of the photoconductors 5, the yellow, magenta, cyan, and black toner images are primarily transferred from the photoconductors 5 onto the intermediate transfer belt 30 by the transfer electric field created at the primary transfer nips such that the yellow, magenta, cyan, and black toner images are superimposed successively on a same position on the intermediate transfer belt 30. Thus, a color toner image is formed on the outer circumferential surface of the intermediate transfer belt 30. After the primary transfer of the yellow, magenta, cyan, and black toner images from the photoconductors 5 onto the intermediate transfer belt 30, the cleaners 8 remove residual toner failed to be transferred onto the intermediate transfer belt 30 and therefore remaining on the photoconductors 5 therefrom. Thereafter, dischargers discharge the outer circumferential surface of the respective photoconductors 5, initializing the surface potential thereof.

On the other hand, the feed roller 11 disposed in the lower portion of the image forming apparatus 1 is driven and rotated to feed a recording medium P from the paper tray 10 toward the registration roller pair 12 in the conveyance path R. As the recording medium P comes into contact with the registration roller pair 12, the registration roller pair 12 that interrupts its rotation temporarily halts the recording medium P.

Thereafter, the registration roller pair 12 resumes its rotation and conveys the recording medium P to the secondary transfer nip at a time when the color toner image formed on the intermediate transfer belt 30 reaches the secondary transfer nip. The secondary transfer roller 36 is applied with a transfer voltage having a polarity opposite a polarity of the charged yellow, magenta, cyan, and black toners constituting the color toner image formed on the intermediate transfer belt 30, thus creating a transfer electric field at the secondary transfer nip. The transfer electric field secondarily transfers the yellow, magenta, cyan, and black toner images constituting the color toner image formed on the intermediate transfer belt 30 onto the recording medium P collectively. After the secondary transfer of the color toner image from the intermediate transfer belt 30 onto the recording medium P, the belt cleaner 35 removes residual toner failed to be transferred onto the recording medium P and therefore remaining on the intermediate transfer belt 30 therefrom. The removed toner is conveyed and collected into the waste toner container.

Thereafter, the recording medium P bearing the color toner image is conveyed to the fixing device 20 that fixes the color toner image on the recording medium P. Then, the recording medium P bearing the fixed color toner image is discharged by the output roller pair 13 onto the output tray 14.

The above describes the image forming operation of the image forming apparatus 1 to form the color toner image on the recording medium P. Alternatively, the image forming apparatus 1 may form a monochrome toner image by using any one of the four image forming devices 4Y, 4M, 4C, and 4K or may form a bicolor or tricolor toner image by using two or three of the image forming devices 4Y, 4M, 4C, and 4K.

Figure 2:
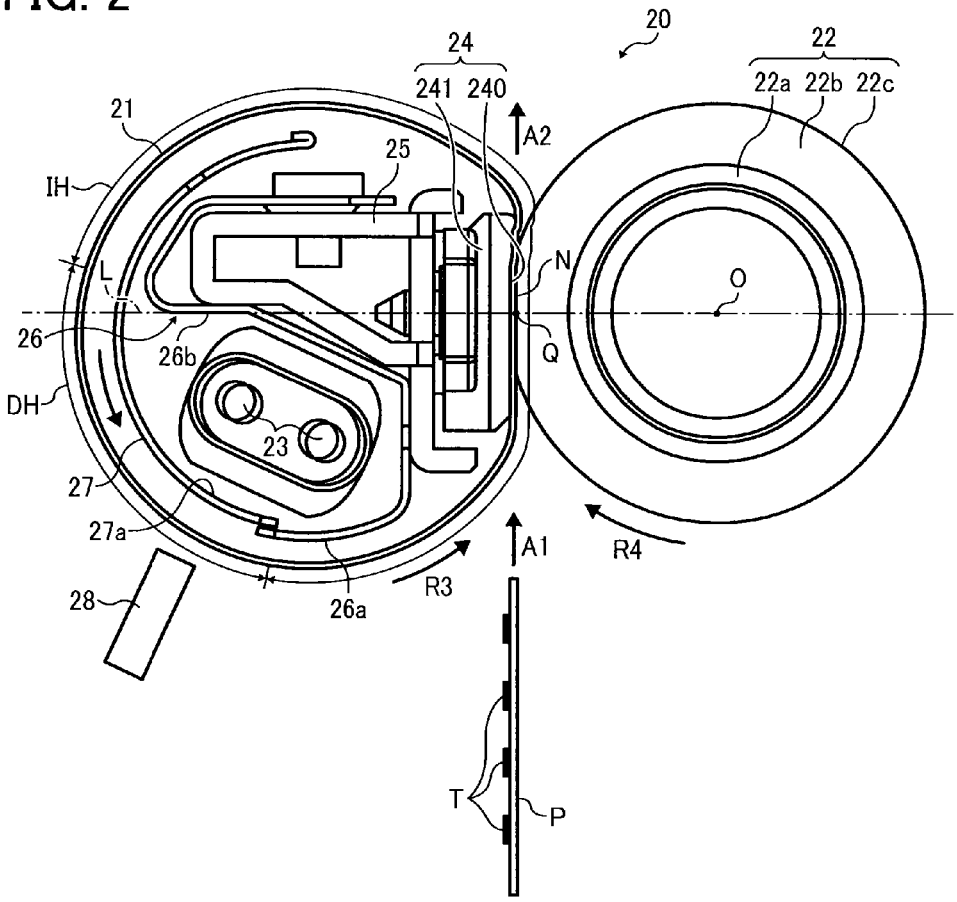
FIG. 2 is a vertical sectional view of a fixing device incorporated in the image forming apparatus shown in FIG. 1 illustrating a heat shield incorporated therein situated at a shield position.
Figure 3:
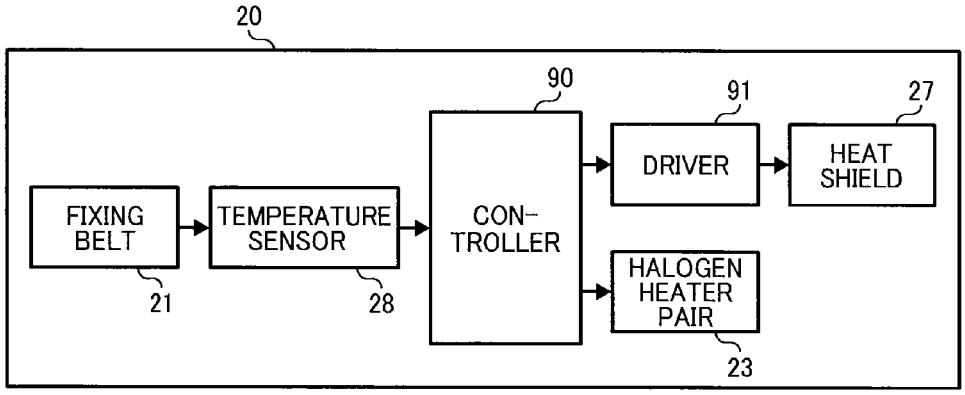
FIG. 3 is a block diagram of the fixing device shown in FIG. 2.

With reference to FIGS. 2 and 3, a description is provided of a construction of the fixing device 20 incorporated in the image forming apparatus 1 described above.

FIG. 2 is a vertical sectional view of the fixing device 20. FIG. 3 is a block diagram of the fixing device 20. As shown in FIG. 2, the fixing device 20 (e.g., a fuser) includes a fixing belt 21 serving as a fixing rotary body or an endless belt formed into a loop and rotatable in a rotation direction R3; a pressing roller 22 serving as an opposed body disposed opposite an outer circumferential surface of the fixing belt 21 and rotatable in a rotation direction R4 counter to the rotation direction R3 of the fixing belt 21; a halogen heater pair 23 serving as a heater disposed inside the loop formed by the fixing belt 21 and heating the fixing belt 21; a nip formation assembly 24 disposed inside the loop formed by the fixing belt 21 and pressing against the pressing roller 22 via the fixing belt 21 to form a fixing nip N between the fixing belt 21 and the pressing roller 22; a stay 25 serving as a support disposed inside the loop formed by the fixing belt 21 and contacting and supporting the nip formation assembly 24; a reflector 26 disposed inside the loop formed by the fixing belt 21 and reflecting light radiated from the halogen heater pair 23 thereto toward the fixing belt 21; a heat shield 27 interposed between the halogen heater pair 23 and the fixing belt 21 to shield the fixing belt 21 from the halogen heater pair 23; a temperature sensor 28 serving as a temperature detector disposed opposite the outer circumferential surface of the fixing belt 21 and detecting the temperature of the fixing belt 21; and a controller 90 depicted in FIG. 3 operatively connected to the temperature sensor 28 and the heat shield 27 to control the rotation angle of the heat shield 27.

A detailed description is now given of a construction of the fixing belt 21.

The fixing belt 21 is a thin, flexible endless belt or film. For example, the fixing belt 21 is constructed of a base layer constituting an inner circumferential surface of the fixing belt 21 and a release layer constituting the outer circumferential surface of the fixing belt 21. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. Alternatively, an elastic layer made of rubber such as silicone rubber, silicone rubber foam, and fluoro rubber may be interposed between the base layer and the release layer.

If the fixing belt 21 does not incorporate the elastic layer, the fixing belt 21 has a decreased thermal capacity that improves fixing performance of being heated to a predetermined fixing temperature quickly. However, as the pressing roller 22 and the fixing belt 21 sandwich and press a toner image T on a recording medium P passing through the fixing nip N, slight surface asperities of the fixing belt 21 may be transferred onto the toner image T on the recording medium P, resulting in variation in gloss of the solid toner image T. To address this problem, it is preferable that the fixing belt 21 incorporates the elastic layer having a thickness not smaller than about 100 micrometers. The elastic layer having the thickness not smaller than about 100 micrometers elastically deforms to absorb slight surface asperities of the fixing belt 21, preventing variation in gloss of the toner image T on the recording medium P.

According to this exemplary embodiment, the fixing belt 21 is designed to be thin and have a reduced loop diameter so as to decrease the thermal capacity thereof. For example, the fixing belt 21 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 21 has a total thickness not greater than about 1 mm. A loop diameter of the fixing belt 21 is in a range of from about 20 mm to about 40 mm. In order to decrease the thermal capacity of the fixing belt 21 further, the fixing belt 21 may have a total thickness not greater than about 0.20 mm and preferably not greater than about 0.16 mm. Additionally, the loop diameter of the fixing belt 21 may not be greater than about 30 mm.

A detailed description is now given of a construction of the pressing roller 22.

The pressing roller 22 is constructed of a metal core 22*a*; an elastic layer 22*b* coating the metal core 22*a* and made of silicone rubber foam, silicone rubber, fluoro rubber, or the like; and a release layer 22*c* coating the elastic layer 22*b* and made of PFA, PTFE, or the like. A pressurization assembly presses the pressing roller 22 against the nip formation assembly 24 via the fixing belt 21. Thus, the pressing roller 22 pressingly contacting the fixing belt 21 deforms the elastic layer 22*b* of the pressing roller 22 at the fixing nip N formed between the pressing roller 22 and the fixing belt 21, thus creating the fixing nip N having a predetermined length in the recording medium conveyance direction A1. According to this exemplary embodiment, the pressing roller 22 is pressed against the fixing belt 21. Alternatively, the pressing roller 22 may merely contact the fixing belt 21 with no pressure therebetween.

A driver (e.g., a motor) disposed inside the image forming apparatus 1 depicted in FIG. 1 drives and rotates the pressing roller 22. As the driver drives and rotates the pressing roller 22, a driving force of the driver is transmitted from the pressing roller 22 to the fixing belt 21 at the fixing nip N, thus rotating the fixing belt 21 by friction between the pressing roller 22 and the fixing belt 21.

According to this exemplary embodiment, the pressing roller 22 is a solid roller. Alternatively, the pressing roller 22 may be a hollow roller. In this case, a heater such as a halogen heater may be disposed inside the hollow roller. The elastic layer 22*b* may be made of solid rubber. Alternatively, if no heater is disposed inside the pressing roller 22, the elastic layer 22*b* may be made of sponge rubber. The sponge rubber is more preferable than the solid rubber because it has an increased insulation that draws less heat from the fixing belt 21.

The halogen heater pair 23 is situated inside the loop formed by the fixing belt 21 and upstream from the fixing nip N in the recording medium conveyance direction A1. For example, the halogen heater pair 23 is situated lower than and upstream from a hypothetical line L passing through a center Q of the fixing nip N in the recording medium conveyance direction A1 and an axis O of the pressing roller 22 in FIG. 2. The power supply situated inside the image forming apparatus 1 supplies power to the halogen heater pair 23 so that the halogen heater pair 23 heats the fixing belt 21.

As shown in FIG. 3, the controller 90 (e.g., a processor), that is, a central processing unit (CPU) provided with a random-access memory (RAM) and a read-only memory (ROM), for example, operatively connected to the halogen heater pair 23 and the temperature sensor 28 controls the halogen heater pair 23 based on the temperature of the fixing belt 21 detected by the temperature sensor 28 so as to adjust the temperature of the fixing belt 21 to a desired fixing temperature. Alternatively, the controller 90 may be operatively connected to a temperature sensor disposed opposite the pressing roller 22 to detect the temperature of the pressing roller 22 so that the controller 90 predicts the temperature of the fixing belt 21 based on the temperature of the pressing roller 22 detected by the temperature sensor, thus controlling the halogen heater pair 23.

As shown in FIG. 2, according to this exemplary embodiment, two halogen heaters constituting the halogen heater pair 23 are situated inside the loop formed by the fixing belt 21. Alternatively, one halogen heater or three or more halogen heaters may be situated inside the loop formed by the fixing belt 21 according to the sizes of the recording media P available in the image forming apparatus 1. However, it is preferable that one or two halogen heaters are situated inside the loop formed by the fixing belt 21 in view of manufacturing costs and limited space inside the loop formed by the fixing belt 21. Alternatively, instead of the halogen heater pair 23, a resistance heat generator, a carbon heater, or the like may be employed as a heater that heats the fixing belt 21 by radiation heat.

A detailed description is now given of a construction of the nip formation assembly 24.

The nip formation assembly 24 includes a base pad 241 and a slide sheet 240 (e.g., a low-friction sheet) covering an outer surface of the base pad 241. For example, the slide sheet 240 covers an opposed face of the base pad 241 disposed opposite the fixing belt 21. A longitudinal direction of the base pad 241 is parallel to an axial direction of the fixing belt 21 or the pressing roller 22. The base pad 241 receives pressure from the pressing roller 22 to define the shape of the fixing nip N. According to this exemplary embodiment, the fixing nip N is planar in cross-section as shown in FIG. 2. Alternatively, the fixing nip N may be concave with respect to the pressing roller 22 or have other shapes. The slide sheet 240 reduces friction between the base pad 241 and the fixing belt 21 sliding over the base pad 241. Alternatively, the base pad 241 may be made of a low friction material. In this case, the slide sheet 240 is not interposed between the base pad 241 and the fixing belt 21.

The base pad 241 is made of a heat resistant material resistant against temperatures of 200 degrees centigrade or higher to prevent thermal deformation of the nip formation assembly 24 by temperatures in a fixing temperature range desirable to fix the toner image T on the recording medium P, thus retaining the shape of the fixing nip N and quality of the toner image T formed on the recording medium P. For example, the base pad 241 is made of general heat resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The base pad 241 is mounted on and supported by the stay 25. Accordingly, even if the base pad 241 receives pressure from the pressing roller 22, the base pad 241 is not bent by the pressure and therefore produces a uniform nip width throughout the entire width of the pressing roller 22 in the axial direction thereof. The stay 25 is made of metal having an increased mechanical strength, such as stainless steel and iron, to prevent bending of the nip formation assembly 24. The base pad 241 is also made of a rigid material having an increased mechanical strength. For example, the base pad 241 is made of resin such as LCP, metal, ceramic, or the like.

A detailed description is now given of a construction of the reflector 26.

The reflector 26 is mounted on and supported by the stay 25 and disposed opposite the halogen heater pair 23. The reflector 26 reflects light or heat radiated from the halogen heater pair 23 thereto onto the fixing belt 21, suppressing conduction of heat from the halogen heater pair 23 to the stay 25. Thus, the reflector 26 facilitates efficient heating of the fixing belt 21, saving energy. For example, the reflector 26 is made of aluminum, stainless steel, or the like. If the reflector 26 includes an aluminum base treated with silver-vapor-deposition to decrease radiation and increase reflectance of light, the reflector 26 heats the fixing belt 21 effectively.

An opposed face of the reflector 26 disposed opposite the halogen heater pair 23 spans in a circumferential direction of the fixing belt 21 over the inner circumferential surface of the fixing belt 21. The reflector 26 includes lateral end portions 26*a* disposed opposite a lower face of the halogen heater pair 23 in FIG. 2 and in proximity to the inner circumferential surface of the fixing belt 21. The lateral end portions 26*a* are curved along the inner circumferential surface of the fixing belt 21 in the circumferential direction thereof. The lateral end portions 26*a* are disposed opposite lateral ends of the halogen heater pair 23 in a longitudinal direction thereof parallel to the axial direction of the fixing belt 21 to shield the fixing belt 21 from the halogen heater pair 23. That is, the lateral end portions 26*a* do not extend throughout the entire width of the reflector 26 in a longitudinal direction thereof parallel to the axial direction of the fixing belt 21.

A detailed description is now given of a configuration of the heat shield 27.

The heat shield 27 is a metal plate, having a thickness in a range of from about 0.1 mm to about 1.0 mm, curved in the circumferential direction of the fixing belt 21 along the inner circumferential surface thereof. As shown in FIG. 2, the heat shield 27 is not circular in the circumferential direction of the fixing belt 21. For example, the heat shield 27 is an arc in cross-section arched along the inner circumferential surface of the fixing belt 21. The heat shield 27 is rotatable clockwise and counterclockwise in FIGS. 2 and 4 in the circumferential direction of the fixing belt 21 on a track interposed between the halogen heater pair 23 and the fixing belt 21.

As shown in FIG. 2, a circumference of the fixing belt 21 is divided into two sections: a circumferential, direct heating span DH where the halogen heater pair 23 is disposed opposite and heats the fixing belt 21 directly and a circumferential, indirect heating span IH where the halogen heater pair 23 is disposed opposite the fixing belt 21 indirectly via the components other than the heat shield 27, that is, the reflector 26, the stay 25, the nip formation assembly 24, and the like. The heat shield 27 moves to a shield position shown in FIG. 2 where the heat shield 27 is disposed opposite the halogen heater pair 23 directly in the direct heating span DH to shield the fixing belt 21 from the halogen heater pair 23. Conversely, the heat shield 27 moves to a retracted position shown in FIG. 4 where the heat shield 27 retracts from the direct heating span DH to the indirect heating span IH and therefore is disposed opposite the halogen heater pair 23 indirectly. That is, the heat shield 27 is behind the reflector 26 and the stay 25 and therefore disposed opposite the halogen heater pair 23 via the reflector 26 and the stay 25. Thus, the heat shield 27 does not shield the fixing belt 21 from the halogen heater pair 23. The heat shield 27 is made of a heat resistant material, for example, metal such as aluminum, iron, and stainless steel or ceramic.

Figure 5:
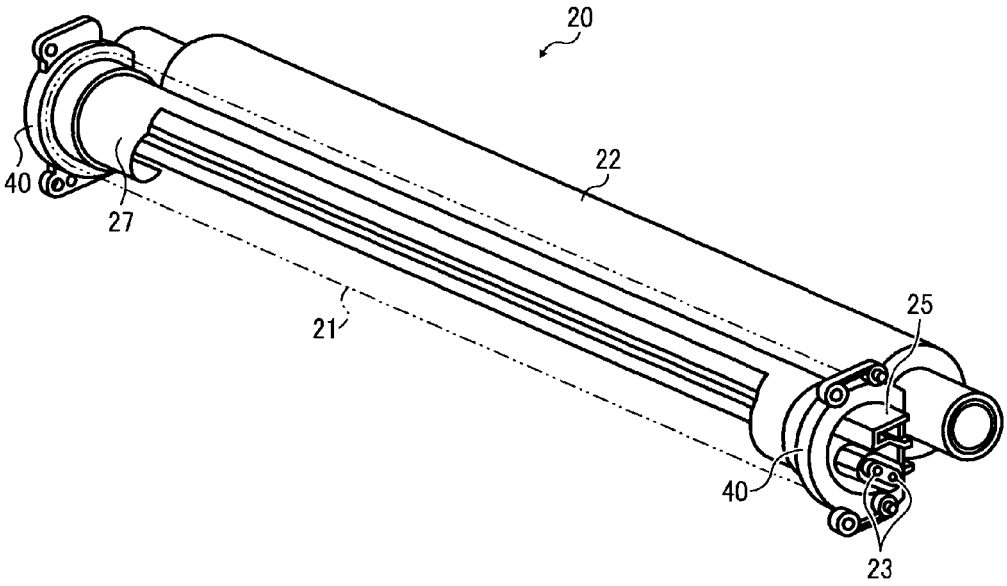
FIG. 5 is a partial perspective view of the fixing device shown in FIG. 4.

With reference to FIG. 5, a description is provided of a configuration of flanges 40 incorporated in the fixing device 20.

FIG. 5 is a partial perspective view of the fixing device 20. As shown in FIG. 5, the flanges 40 serving as a belt holder are inserted into both lateral ends of the fixing belt 21 in the axial direction thereof, respectively, to rotatably support the fixing belt 21. Both lateral ends of the flanges 40, the halogen heater pair 23, and the stay 25 in the axial direction of the fixing belt 21 are mounted on and supported by a pair of side plates of the fixing device 20, respectively.

Figure 6:
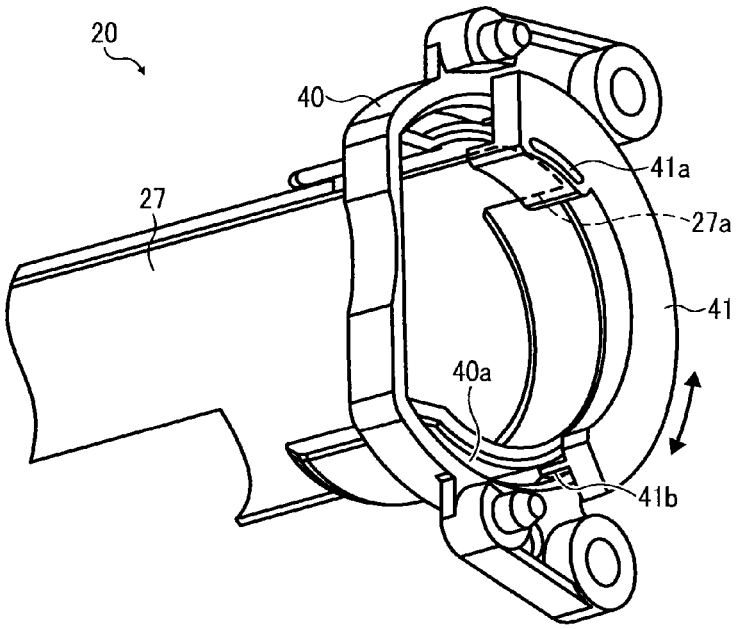
FIG. 6 is a partial perspective view of the fixing device shown in FIG. 2 illustrating one lateral end of the heat shield in an axial direction thereof.

With reference to FIG. 6, a description is provided of a construction of a support mechanism that supports the heat shield 27.

FIG. 6 is a partial perspective view of the fixing device 20 illustrating one lateral end of the heat shield 27 in the axial direction of the fixing belt 21. As shown in FIG. 6, the heat shield 27 is supported by an arcuate slider 41 rotatably or slidably attached to the flange 40. For example, a projection 27*a* disposed at each lateral end of the heat shield 27 in the axial direction of the fixing belt 21 is inserted into a hole 41*a* produced in the slider 41. Thus, the heat shield 27 is attached to the slider 41. The slider 41 includes a tab 41*b* projecting inboard in the axial direction of the fixing belt 21 toward the heat shield 27. As the tab 41*b* of the slider 41 is inserted into an arcuate groove 40*a* produced in the flange 40, the slider 41 is slidably movable in the groove 40*a*. Accordingly, the heat shield 27, together with the slider 41, is rotatable or movable in a circumferential direction of the flange 40. The flange 40 and the slider 41 are made of resin.

Although FIG. 6 illustrates the support mechanism that supports the heat shield 27 at one lateral end thereof in the axial direction of the fixing belt 21, another lateral end of the heat shield 27 in the axial direction of the fixing belt 21 is also supported by the support mechanism shown in FIG. 6. Thus, another lateral end of the heat shield 27 is also rotatably or movably supported by the slider 41 slidable in the groove 40*a* of the flange 40.

Figure 7:
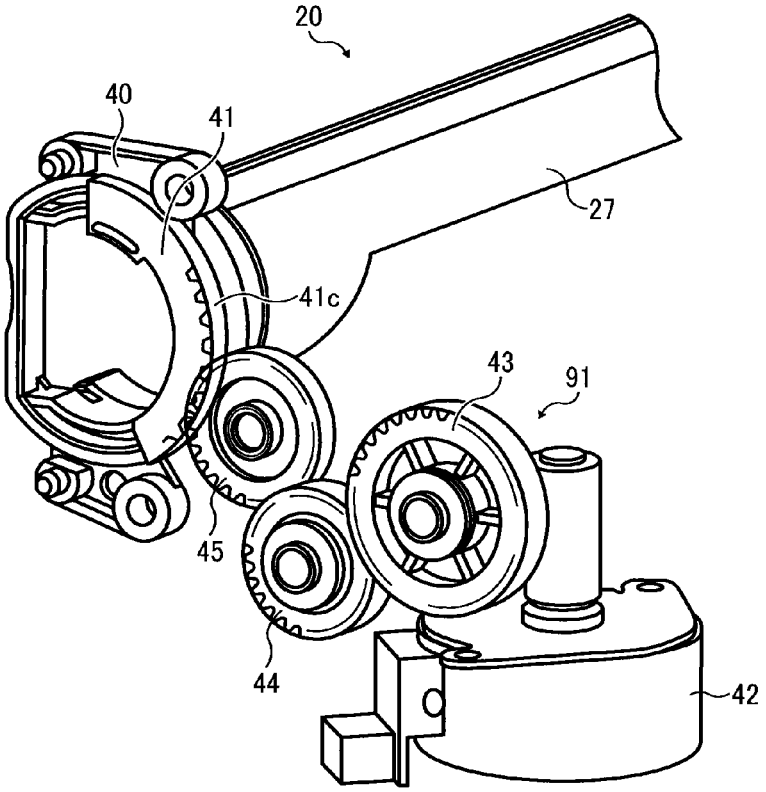
FIG. 7 is a partial perspective view of the fixing device shown in FIG. 2 illustrating a driver incorporated therein.

With reference to FIG. 7, a description is provided of a construction of a driver 91 that drives and rotates the heat shield 27.

FIG. 7 is a partial perspective view of the fixing device 20 illustrating the driver 91. As shown in FIG. 7, the driver 91 includes a motor 42 serving as a driving source and a plurality of gears 43, 44, and 45 constituting a gear train. The gear 43 serving as one end of the gear train is connected to the motor 42. The gear 45 serving as another end of the gear train is connected to a gear 41*c* produced on the slider 41 along a circumferential direction thereof. Accordingly, as the motor 42 is driven, a driving force is transmitted from the motor 42 to the gear 41*c* of the slider 41 through the gear train, that is, the gears 43 to 45, thus rotating the heat shield 27 supported by the slider 41.

Figure 8:
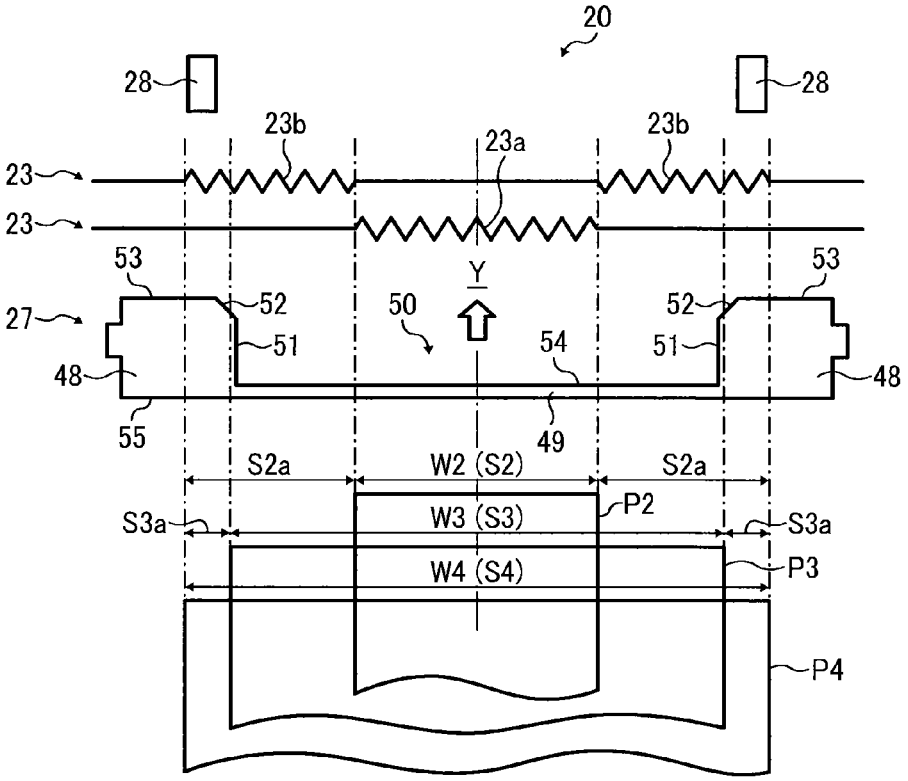
FIG. 8 is a schematic diagram of the fixing device shown in FIG. 4 illustrating a halogen heater pair incorporated therein, the heat shield, and the sizes of recording media.

With reference to FIG. 8, a description is provided of a relation between the shape of the heat shield 27, heat generators of the halogen heater pair 23, and the sizes of recording media.

FIG. 8 is a schematic diagram of the fixing device 20 illustrating the halogen heater pair 23, the heat shield 27, and the sizes of recording media.

First, a detailed description is given of the shape of the heat shield 27. It is to be noted that an axial direction of the heat shield 27 defines a direction in which an axis of the heat shield 27 extends in the axial direction of the fixing belt 21. A circumferential direction of the heat shield 27 defines a direction in which the heat shield 27 rotates in the circumferential direction of the fixing belt 21.

As shown in FIG. 8, the heat shield 27 includes a pair of shield portions 48, constituting both lateral ends of the heat shield 27 in the axial direction thereof; a bridge 49 bridging the shield portions 48 in the axial direction of the heat shield 27; and a recess 50 defined by the shield portions 48 and the bridge 49, and in turn itself defining an inboard edge of each shield portion 48. The recess 50 between the pair of shield portions 48 in the axial direction of the heat shield 27 is defined and enclosed by the inboard edge of each shield portion 48 in the axial direction of the heat shield 27 and an inner edge 54 of the bridge 49, that is, one end of the bridge 49 in the circumferential direction of the heat shield 27, constituting a bottom of the recess 50. The shield portions 48 are disposed opposite both lateral ends of the halogen heater pair 23 in the axial direction of the fixing belt 21, respectively, to shield both lateral ends of the fixing belt 21 in the axial direction thereof from the halogen heater pair 23. In the present embodiment, the pair of shield portions 48 and the bridge 49 constituting the heat shield 27 are in a single metal plate. The recess 50 between the pair of shield portions 48 in the axial direction of the heat shield 27 does not shield the fixing belt 21 from the halogen heater pair 23 and therefore allows light radiated from the halogen heater pair 23 to irradiate the fixing belt 21.

Each shield portion 48 includes an axially straight edge 53 constituting one end of the shield portion 48 in the circumferential direction of the heat shield 27 and extending in the axial direction thereof. The axially straight edge 53 extends substantially throughout the entire width of the shield portion 48 in the axial direction of the heat shield 27 except for a sloped edge 52, a detailed description of which is deferred. The axially straight edge 53 of the shield portion 48 is disposed downstream from the inner edge 54 of the bridge 49 in the rotation direction R3 of the fixing belt 21 depicted in FIG. 2. For example, the shield portions 28 are disposed downstream from the bridge 49 in a shield direction Y, equivalent to the rotation direction R3 of the fixing belt 21, in which the heat shield 27 rotates and moves to the shield position shown in FIG. 2.

The inner edge 54 of the bridge 49 is connected to the axially straight edge 53 of one shield portion 48 through the inboard edge of the shield portion 48 that is disposed opposite the inboard edge of another shield portion 48. The inboard edge of the shield portion 48 includes a circumferentially straight edge 51 extending parallel to the circumferential direction of the heat shield 27 in which the heat shield 27 rotates and the sloped edge 52 angled relative to the circumferentially straight edge 51. As shown in FIG. 8, the sloped edge 52 is contiguous to the circumferentially straight edge 51 substantially in the shield direction Y. The sloped edge 52 is angled outboard from the circumferentially straight edge 51 substantially in the shield direction Y such that an interval between the sloped edge 52 and another sloped edge 52 increases. Accordingly, the recess 50 has a uniform, decreased width defined by the circumferentially straight edges 51 in the axial direction of the heat shield 27 and an increased width defined by the sloped edges 52 in the axial direction of the heat shield 27 that increases gradually in the shield direction Y. An outer edge 55 of the heat shield 27 situated at another end of the heat shield 27 in the circumferential direction thereof and defining an outer edge of the bridge 49 and the shield portions 48 extends straight in the axial direction of the heat shield 27.

Next, a detailed description is given of a relation between the heat generators of the halogen heater pair 23 and the sizes of the recording media.

As shown in FIG. 8, the halogen heater pair 23 has a plurality of heat generators having different lengths in the axial direction of the fixing belt 21 and being situated at different positions in the axial direction of the fixing belt 21 to heat different axial spans on the fixing belt 21 according to the size of the recording medium P. For example, the halogen heater pair 23 is constructed of the lower halogen heater 23 having a center heat generator 23*a* disposed opposite a center of the fixing belt 21 in the axial direction thereof and the upper halogen heater 23 having lateral end heat generators 23*b* disposed opposite both lateral ends of the fixing belt 21 in the axial direction thereof, respectively. The center heat generator 23*a* spans a conveyance span S2 corresponding to a width W2 of a medium recording medium P2 in the axial direction of the fixing belt 21. Conversely, the lateral end heat generators 23*b*, together with the center heat generator 23*a*, span a conveyance span S3 corresponding to a width W3 of a large recording medium P3 greater than the width W2 of the medium recording medium P2 and a conveyance span S4 corresponding to a width W4 of an extra-large recording medium P4 greater than the width W3 of the large recording medium P3.

A detailed description is now given of a relation between the shape of the heat shield 27 and the sizes of the recording media P2, P3, and P4.

Each circumferentially straight edge 51 is situated inboard from and in proximity to an edge of the conveyance span S3 corresponding to the width W3 of the large recording medium P3 in the axial direction of the fixing belt 21. Each sloped edge 52 overlaps a side edge of a standard size recording medium in the axial direction of the fixing belt 21. According to this exemplary embodiment, each sloped edge 52 overlaps the edge of the conveyance span S3 corresponding to the width W3 of the large recording medium P3 as the standard size recording medium in the axial direction of the fixing belt 21.

For example, the medium recording medium P2 is a letter size recording medium having a width W2 of 215.9 mm or an A4 size recording medium having a width W2 of 210 mm. The large recording medium P3 is a double letter size recording medium having a width W3 of 279.4 mm or an A3 size recording medium having a width W3 of 297 mm. The extra-large recording medium P4 is an A3 extension size recording medium having a width W4 of 329 mm. However, the small recording medium P1, the medium recording medium P2, the large recording medium P3, and the extra-large recording medium P4 may include recording media of other sizes. Additionally, the medium, large, and extra-large sizes mentioned herein are relative terms. Hence, instead of the medium, large, and extra-large sizes, small, medium, and large sizes may be used.

With reference to FIG. 2, a description is provided of a fixing operation of the fixing device 20 described above.

As the image forming apparatus 1 depicted in FIG. 1 is powered on, the power supply supplies power to the halogen heater pair 23 and at the same time the driver drives and rotates the pressing roller 22 clockwise in FIG. 2 in the rotation direction R4. Accordingly, the fixing belt 21 rotates counterclockwise in FIG. 2 in the rotation direction R3 in accordance with rotation of the pressing roller 22 by friction between the pressing roller 22 and the fixing belt 21.

A recording medium P bearing a toner image T formed by the image forming operation of the image forming apparatus 1 described above is conveyed in the recording medium conveyance direction A1 while guided by a guide plate and enters the fixing nip N formed between the fixing belt 21 and the pressing roller 22 pressed against the fixing belt 21. The fixing belt 21 heated by the halogen heater pair 23 heats the recording medium P and at the same time the pressing roller 22 pressed against the fixing belt 21, together with the fixing belt 21, exerts pressure on the recording medium P, thus fixing the toner image T on the recording medium P.

The recording medium P bearing the fixed toner image T is discharged from the fixing nip N in a recording medium conveyance direction A2. As a leading edge of the recording medium P comes into contact with a front edge of a separator, the separator separates the recording medium P from the fixing belt 21. Thereafter, the separated recording medium P is discharged by the output roller pair 13 depicted in FIG. 1 onto the outside of the image forming apparatus 1, that is, the output tray 14 where the recording medium P is stocked.

As described above, since the fixing belt 21 has a reduced thermal capacity and the pressing roller 22 incorporates the insulative elastic layer 22*b* that facilitates heating of the thin release layer 22*c*, the fixing belt 21 and the pressing roller 22 are heated to a desired fixing temperature to fix the toner image T on the recording medium P with a reduced amount of heat.

With reference to FIG. 8, a description is provided of control of the halogen heater pair 23 and the heat shield 27 according to the sizes of recording media.

As the medium recording medium P2 is conveyed over the fixing belt 21 depicted in FIG. 2, the controller 90 depicted in FIG. 3 turns on the center heat generator 23*a* to heat the conveyance span S2 of the fixing belt 21 corresponding to the width W2 of the medium recording medium P2. As the extra-large recording medium P4 is conveyed over the fixing belt 21, the controller 90 turns on the lateral end heat generators 23*b* as well as the center heat generator 28*a* to heat the conveyance span S4 of the fixing belt 21 corresponding to the width W4 of the extra-large recording medium P4.

However, the halogen heater pair 23 is configured to heat the conveyance span S2 corresponding to the width W2 of the medium recording medium P2 and the conveyance span S4 corresponding to the width W4 of the extra-large recording medium P4. Accordingly, if the center heat generator 23*a* is turned on as the large recording medium P3 is conveyed over the fixing belt 21, the center heat generator 23*a* does not heat each outboard span S2a outboard from the conveyance span S2 in the axial direction of the fixing belt 21. Consequently, the large recording medium P3 is not heated throughout the entire width W3 thereof. Conversely, if the lateral end heat generators 23*b* are turned on in addition to the center heat generator 23*a*, the lateral end heat generators 23*b* and the center heat generator 23*a* heat the conveyance span S4 greater than the conveyance span S3 corresponding to the width W3 of the large recording medium P3. If the large recording medium P3 is conveyed over the fixing belt 21 while the lateral end heat generators 23*b* and the center heat generator 23*a* are turned on, the lateral end heat generators 23*b* may heat both outboard spans S3a outboard from the conveyance span S3 corresponding to the width W3 of the large recording medium P3, resulting in overheating of the fixing belt 21 in the outboard spans S3a.

Figure 9:
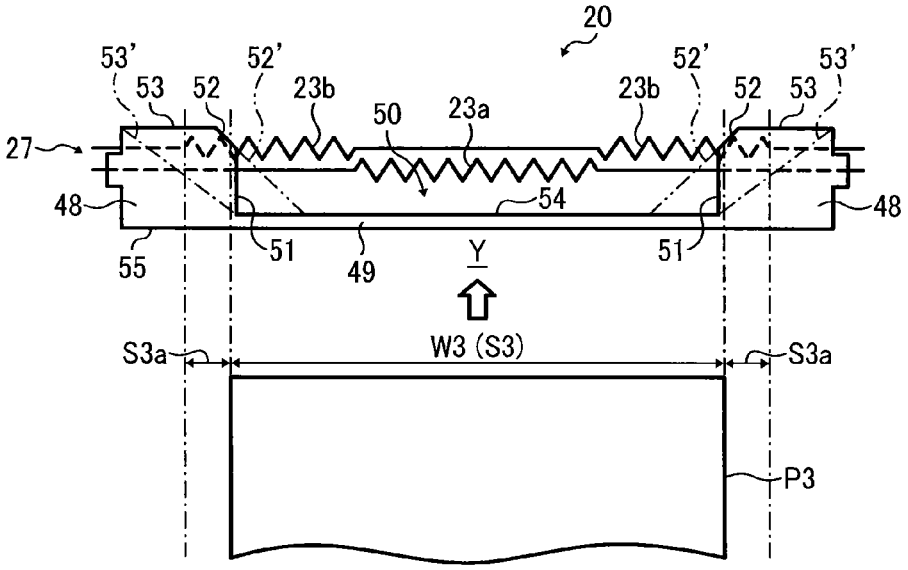
FIG. 9 is a schematic diagram of the fixing device shown in FIG. 2 illustrating the heat shield at the shield position.

To address this circumstance, as the large recording medium P3 is conveyed over the fixing belt 21, the heat shield 27 moves to the shield position as shown in FIG. 9. FIG. 9 is a schematic diagram of the fixing device 20. At the shield position shown in FIG. 9, the shield portions 48 of the heat shield 27 shield the fixing belt 21 in a span in proximity to both side edges of the large recording medium P3 and the outboard spans S3a, thus suppressing overheating of the fixing belt 21 in the outboard spans S3a where the large recording medium P3 is not conveyed.

Figure 4:
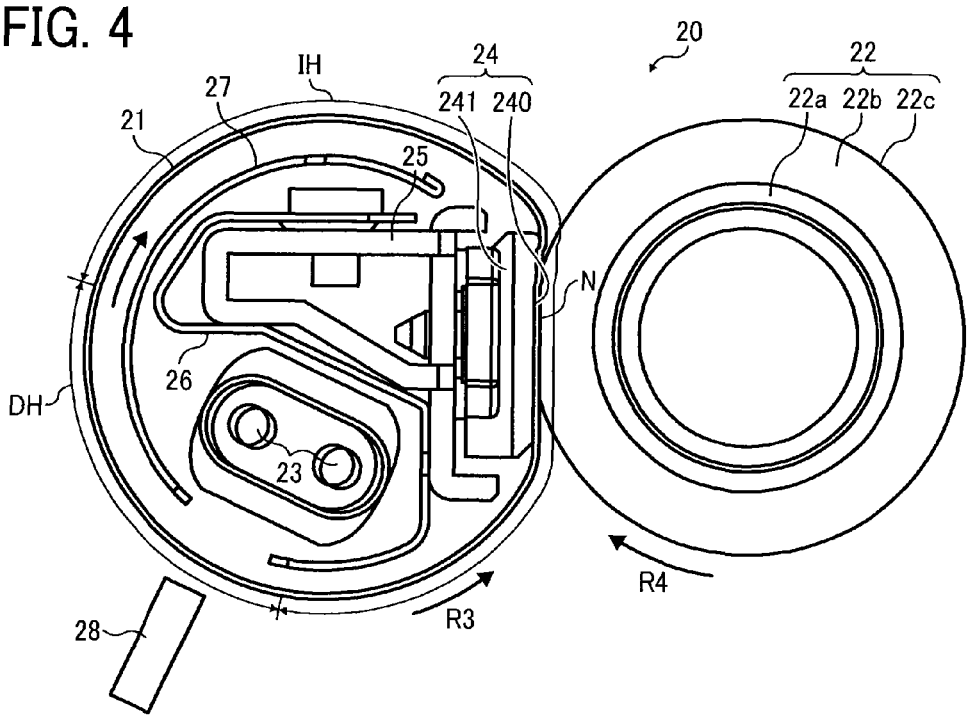
FIG. 4 is a vertical sectional view of the fixing device shown in FIG. 2 illustrating the heat shield situated at a retracted position.

When a fixing job is finished or the temperature of the outboard span S3a of the fixing belt 21 where the large recording medium P3 is not conveyed decreases to a predetermined threshold and therefore the heat shield 27 is no longer requested to shield the fixing belt 21, the controller 90 moves the heat shield 27 to the retracted position shown in FIG. 4. Thus, the fixing device 20 performs the fixing job precisely by moving the heat shield 27 to the shield position shown in FIG. 2 at a proper time without decreasing the rotation speed of the fixing belt 21 and the pressing roller 22 to convey the large recording medium P3. Whether the heat shield 27 is at the shield position shown in FIG. 2 or at the retracted position shown in FIG. 4, the bridge 49 of the heat shield 27 is disposed opposite the indirect heating span IH shown in FIGS. 2 and 4. Accordingly, the bridge 49 is not heated by the halogen heater pair 23 directly.

As shown in FIGS. 2 and 4, a rotation axis of the heat shield 27 is situated in proximity to a center of the fixing belt 21 in cross-section, that is, a rotation axis of the fixing belt 21; a center of the halogen heater pair 23, that is, a center of a filament of each of the center heat generator 23*a* and the lateral end heat generators 23*b*, is situated closer to the inner circumferential surface of the fixing belt 21 than the rotation axis of the heat shield 27 is. Accordingly, at the shield position shown in FIG. 2, the heat shield 27 is disposed opposite the halogen heater pair 23 with a decreased interval therebetween. Conversely, at the retracted position shown in FIG. 4, the heat shield 27 is disposed opposite the halogen heater pair 23 with an increased interval therebetween. Consequently, at the retracted position, the heat shield 27 is less exposed to light radiated from the halogen heater pair 23 and therefore is less susceptible to overheating.

As shown in FIG. 4, since the nip formation assembly 24 is situated inside the loop formed by the fixing belt 21, the nip formation assembly 24 prohibits the heat shield 27 from moving to the fixing nip N. To address this circumstance, the halogen heater pair 23 is situated upstream from the fixing nip N in the rotation direction R3 of the fixing belt 21 so that the heat shield 27 is movable between the shield position shown in FIG. 2 where the heat shield 27 is situated at an upstream position upstream from the fixing nip N in the rotation direction R3 of the fixing belt 21 and the retracted position shown in FIG. 4 where the heat shield 27 is situated at a downstream position downstream from the fixing nip N in the rotation direction R3 of the fixing belt 21. Accordingly, the heat shield 27 retracts to the downstream, retracted position shown in FIG. 4 where the nip formation assembly 24 does not interfere with movement of the heat shield 27 while increasing a circumferential moving span of the heat shield 27 that moves in the circumferential direction of the fixing belt 21. Such configuration to increase the circumferential moving span of the heat shield 27 is advantageous for the fixing device 20 incorporating the fixing belt 21 having a smaller diameter to reduce its thermal capacity because the smaller fixing belt 21 creates a smaller loop that accommodates a smaller interior space.

Since each shield portion 48 includes the sloped edge 52 as shown in FIG. 8, as the rotation angle of the heat shield 27 changes, the shield portions 48 shield the fixing belt 21 in a variable area changed by stepless adjustment, especially at a smallest interval between the lateral end heat generators 23*b* and the fixing belt 21. For example, if the number of recording media conveyed through the fixing nip N and a conveyance time for which the recording media are conveyed through the fixing nip N increase, the fixing belt 21 is subject to overheating in a non-conveyance span (e.g., the outboard spans S2a and S3a) thereof. To address this circumstance, when the number of recording media conveyed through the fixing nip N reaches a predetermined number or when the conveyance time reaches a predetermined conveyance time, the controller 90 moves the heat shield 27 in the shield direction Y to the shield position shown in FIG. 2 where the shield portions 48 are disposed opposite the lateral end heat generators 23*b*, respectively, suppressing overheating of the fixing belt 21 precisely.

With reference to FIG. 9, a description is provided of the slope of the shield portion 48 of the heat shield 27.

As shown in FIG. 9, the shield portion 48 may include a sloped edge 53', indicated by the alternate long and short dashed line in FIG. 9, which forms the shield portion 48 into a triangle, instead of the sloped edge 52 and the axially straight edge 53. The sloped edge 53' is contiguous to and angled relative to the inner edge 54 of the bridge 49 extending in the axial direction of the heat shield 27, increasing the slope of the shield portion 48 that changes the variable area on the fixing belt 21 shielded by the shield portion 48. However, since the sloped edge 53' decreases the area of the shield portion 48 compared to the sloped edge 52, the sloped edge 53' decreases an amount of light from the halogen heater pair 23 that is shielded by the shield portion 48, overheating the fixing belt 21. To address this circumstance, it is preferable that the shield portion 48 includes the axially straight edge 53 indicated by the solid line in FIG. 9 that extends in the axial direction of the heat shield 27 at one end of the heat shield 27 in the circumferential direction thereof.

Alternatively, the shield portion 48 may include a sloped edge 52' indicated by the alternate long and two short dashed line in FIG. 9 that forms the shield portion 48 into a trapezoid, instead of the sloped edge 52. The sloped edge 52' is contiguous to the axially straight edge 53 and the inner edge 54 of the bridge 49 and angled relative to the inner edge 54 of the bridge 49. Since the sloped edge 52' decreases the area of the recess 50, the sloped edge 52' may allow the halogen heater pair 23 to heat the fixing belt 21 in a decreased area, resulting in insufficient heating of the fixing belt 21 in the conveyance span S3 corresponding to the width W3 of the large recording medium P3, for example. To address this circumstance, it is preferable that the shield portion 48 includes the circumferentially straight edge 51 abutting the recess 50 to secure the desired area of the recess 50.

The temperature sensor 28 for detecting the temperature of the fixing belt 21 is disposed opposite an axial span on the fixing belt 21 where the fixing belt 21 is subject to overheating. According to this exemplary embodiment, as shown in FIG. 8, the temperature sensor 28 is disposed opposite each outboard span S3a outboard from the conveyance span S3 corresponding to the width W3 of the large recording medium P3 because the fixing belt 21 is subject to overheating in the outboard span S3a. Since the fixing belt 21 is subject to overheating by light radiated from the lateral end heat generators 23*b*, the temperature sensors 28 are disposed opposite the lateral end heat generators 23*b*, respectively.

Figure 10:
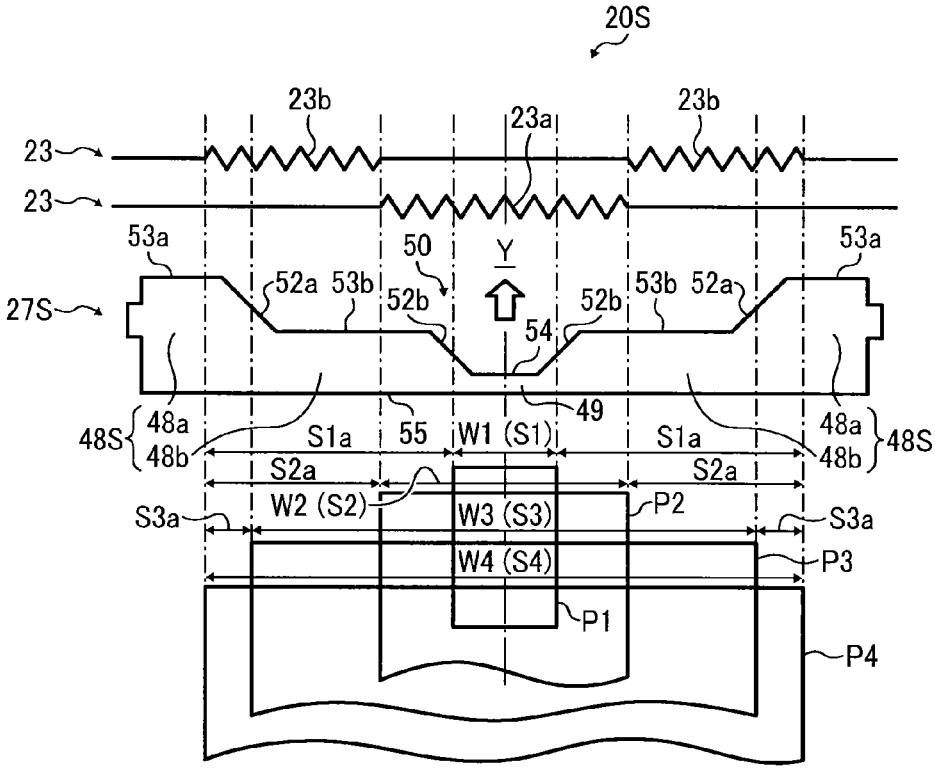
FIG. 10 is a schematic diagram of a fixing device according to another exemplary embodiment of the present invention.
Figure 11:
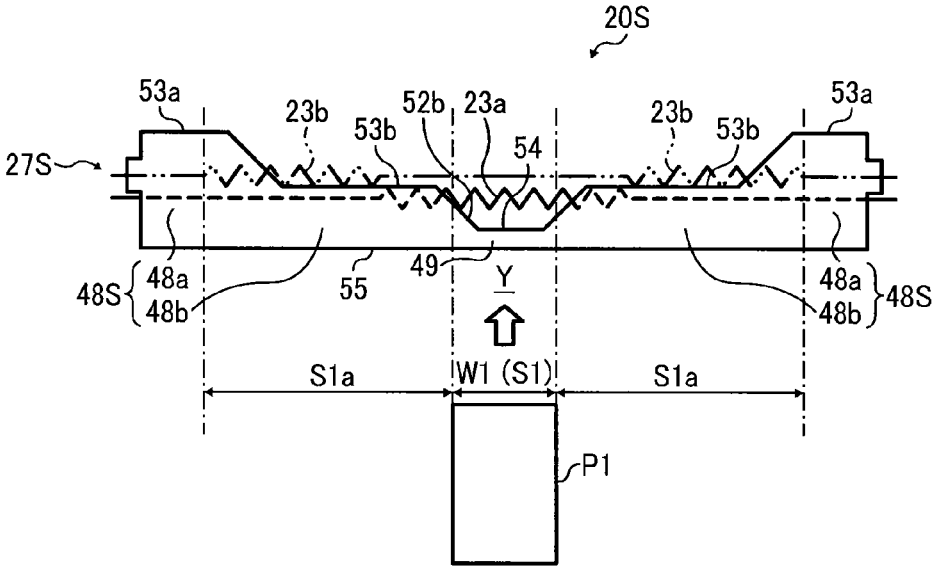
FIG. 11 is a schematic diagram of the fixing device shown in FIG. 10 illustrating the heat shield at the shield position.

With reference to FIGS. 10 and 11, a description is provided of a configuration of a fixing device 20S incorporating a heat shield 27S according to another exemplary embodiment.

FIG. 10 is a schematic diagram of the fixing device 20S. FIG. 11 is a partial schematic diagram of the fixing device 20S. As shown in FIG. 10, the heat shield 27S includes a pair of shield portions 48S disposed at both lateral ends of the heat shield 27S in an axial direction thereof, respectively. Each of the shield portions 48S has two steps. For example, each shield portion 48S includes a first shield section 48*b* having an increased length in a longitudinal direction of the heat shield 27S parallel to the axial direction thereof and a second shield section 48*a* having a decreased length in the longitudinal direction of the heat shield 27S. The bridge 49 bridges the first shield section 48*b* of one shield portion 48S serving as a primary shield portion situated at one lateral end of the heat shield 27S and the first shield section 48*b* of another shield portion 48S serving as a secondary shield portion situated at another lateral end of the heat shield 27S in the axial direction thereof. The second shield section 48*a* is contiguous to and outboard from the first shield section 48*b* in the axial direction of the heat shield 27S.

An axially straight edge 53*a* situated at one end of the second shield section 48*a* in a circumferential direction of the heat shield 27S, that is, the rotation direction R3 of the fixing belt 21, is disposed downstream from an axially straight edge 53*b* situated at one end of the first shield section 48*b* in the circumferential direction of the heat shield 27S in the shield direction Y. The axially straight edge 53*b* is disposed downstream from the inner edge 54 of the bridge 49 in the shield direction Y. A sloped edge 52*a*, that is, an inboard edge of the second shield section 48*a* in the axial direction of the heat shield 27S, is disposed opposite another sloped edge 52*a*, that is, an inboard edge of another second shield section 48*a* in the axial direction of the heat shield 27S.

Similarly, a sloped edge 52*b*, that is, an inboard edge of the first shield section 48*b* in the axial direction of the heat shield 27S, is disposed opposite another sloped edge 52*b*, that is, an inboard edge of another first shield section 48*b* in the axial direction of the heat shield 27S. That is, the sloped edges 52*a* and 52*b* constitute an inboard edge of the shield portion 48S in the axial direction of the heat shield 27S. The sloped edge 52*b* and the axially straight edge 53*b* constitute a first inboard edge of the first shield section 48*b*. The sloped edge 52*a* constitutes a second inboard edge of the second shield section 48*a*. The recess 50 between the pair of shield portions 48S in the axial direction of the heat shield 27S is defined and enclosed by the inboard edge 52*a* of each second shield section 48*a*, the axially straight edge 53*b* and the inboard edge 52*b* of each first shield section 48*b*, and the inner edge 54 of the bridge 49.

The two first shield sections 48*b* are coupled through the bridge 49. The second shield section 48*a* is contiguous to the first shield section 48*b* substantially in the shield direction Y as well as in the axial direction of the heat shield 27S. The two sloped edges 52*b* of the first shield sections 48*b* are angled relative to the inner edge 54 of the bridge 49 such that an interval between the two sloped edges 52*b* in the axial direction of the heat shield 27S increases gradually in the shield direction Y. Similarly, the two sloped edges 52*a* of the second shield sections 48*a* are angled relative to the axially straight edges 53*b* of the first shield sections 48*b* such that an interval between the two sloped edges 52*a* in the axial direction of the heat shield 27S increases gradually in the shield direction Y. Unlike the heat shield 27 depicted in FIG. 8, the heat shield 27S does not incorporate the circumferentially straight edges 51.

At least four sizes of recording media P including a small recording medium P1, a medium recording medium P2, a large recording medium P3, and an extra-large recording medium P4, are available in the fixing device 20S. For example, the small recording medium P1 includes a postcard having a width of 100 mm. The medium recording medium P2 includes an A4 size recording medium having a width of 210 mm. The large recording medium P3 includes an A3 size recording medium having a width of 297 mm. The extra-large recording medium P4 includes an A3 extension size recording medium having a width of 329 mm. However, the small recording medium P1, the medium recording medium P2, the large recording medium P3, and the extra-large recording medium P4 may include recording media of other sizes.

A width W1 of the small recording medium P1 is smaller than the length of the center heat generator 23*a* in the longitudinal direction of the halogen heater pair 23 parallel to the axial direction of the heat shield 27S. The sloped edge 52*b* of the first shield section 48*b* overlaps a side edge of the small recording medium P1. The sloped edge 52*a* of the second shield section 48*a* overlaps a side edge of the large recording medium P3. It is to be noted that a description of the relation between the position of recording media other than the small recording medium P1, that is, the medium recording medium P2, the large recording medium P3, and the extra-large recording medium P4, and the position of the center heat generator 23*a* and the lateral end heat generators 23*b* of the fixing device 20S is omitted because it is similar to that of the fixing device 20 described above.

As the small recording medium P1 is conveyed through the fixing nip N, the center heat generator 23*a* is turned on. However, since the center heat generator 23*a* heats the conveyance span S2 on the fixing belt 21 corresponding to the width W2 of the medium recording medium P2 that is greater than the width W1 of the small recording medium P1, the controller 90 moves the heat shield 27S to the shield position shown in FIG. 11. At the shield position, each first shield section 48*b* of the heat shield 27S shields the fixing belt 21 from the center heat generator 23*a* in an outboard span S1a outboard from a conveyance span S1 corresponding to the width W1 of the small recording medium P1 in the axial direction of the fixing belt 21. Accordingly, the fixing belt 21 does not overheat in each outboard span S1a where the small recording medium P1 is not conveyed over the fixing belt 21.

As the medium recording medium P2, the large recording medium P3, and the extra-large recording medium P4 are conveyed through the fixing nip N, the controller 90 performs a control for controlling the halogen heater pair 23 and the heat shield 27S that is similar to the control for controlling the halogen heater pair 23 and the heat shield 27 described above. In this case, each second shield section 48*a* of the heat shield 27S shields the fixing belt 21 from the halogen heater pair 23 as each shield portion 48 of the fixing device 20 does.

Like the shield portion 48 of the fixing device 20 that has the sloped edge 52, the second shield section 48*a* and the first shield section 48*b* have the sloped edges 52*a* and 52*b*, respectively. Accordingly, by changing the rotation angled position of the heat shield 27S, the controller 90 changes the span on the fixing belt 21 shielded from the center heat generator 23*a* and the lateral end heat generators 23*b* of the halogen heater pair 23 by the second shield section 48*a* and the first shield section 48*b* of each shield portion 48S.

The present invention is not limited to the details of the exemplary embodiments described above, and various modifications and improvements are possible. Further, the shape of the heat shield is not limited to that of the heat shields 27 and 27S. For example, the heat shield may have three or more steps corresponding to the sizes of recording media available in the fixing device.

According to the exemplary embodiments described above, the heat shields 27 and 27S are arc-shaped in cross-section as shown in FIGS. 2 and 4. Alternatively, the heat shields 27 and 27S may be curved into shapes other than the arc-shape or have a straight section.

Further, as the heat shield 27 is at the retracted position shown in FIG. 4, a part of the heat shield 27 is disposed opposite the direct heating span DH on the fixing belt 21 and therefore heated by the halogen heater pair 23 directly. Alternatively, the entire heat shield 27 may be configured to be disposed opposite the indirect heating span IH on the fixing belt 21 by modifying the shape and the circumferential moving span of the heat shield 27 or the shape of the stay 25 and the reflector 26. In this case, the heat shield 27 at the retracted position is not heated by the halogen heater pair 23 and thereby is not susceptible to thermal deformation and wear.

Incidentally, if the nip formation assembly 24 is situated inside the loop formed by the fixing belt 21 as shown in FIG. 2, the heat shield 27 is requested to be noncircular in the circumferential direction of the fixing belt 21 throughout the entire conveyance span on the fixing belt 21 in the axial direction thereof where the recording media are conveyed so as to prevent interference with the nip formation assembly 24. For example, if recording media of a plurality of sizes are available in the image forming apparatus 1, the heat shield 27 is requested to be noncircular throughout the entire conveyance span on the fixing belt 21 where a recording medium of maximum size available in the image forming apparatus 1 is conveyed. However, the noncircular shield 27 in the circumferential direction of the fixing belt 21, if it overheats, may thermally deform and turn inward or outward at a circumferential end thereof.

Additionally, if the heat shield 27 is configured to be movable, the components supporting the heat shield 27, that is, the slider 41 and the flange 40 depicted in FIG. 7, are requested to be drivable. For example, play (e.g., a gap) is requested between the slider 41 and the flange 40. However, in this case, compared to a configuration in which the heat shield 27 is mounted on a side plate of the fixing device 20, the gap between the slider 41 and the flange 40 may decrease an amount of heat dissipated from the heat shield 27 through the slider 41 and the flange 40. Such decreased dissipation of heat is not limited to the configuration of the fixing device 20. Generally, a movable shield like the heat shield 27 is subject to storage heat compared to a stationary shield, which may result in thermal deformation.

As shown in FIG. 2, the reflector 26 includes an opposed face 26*b* disposed opposite the halogen heater pair 23, which spans a substantial area of the inner circumferential surface of the fixing belt 21. Accordingly, light radiated from the halogen heater pair 23 irradiates the heat shield 27 in an increased area. Consequently, the heat shield 27 is subject to overheating. The reflector 26 includes the lateral end portions 26*a* disposed opposite the lower face of the halogen heater pair 23 in FIG. 2. The lateral end portions 26*a* are disposed opposite the lateral ends of the halogen heater pair 23 in the longitudinal direction thereof to shield the fixing belt 21 from the halogen heater pair 23. That is, the lateral end portions 26*a* do not extend throughout the entire width of the reflector 26 in the longitudinal direction thereof.

To address this circumstance, the heat shield 27 has a configuration below to prevent thermal deformation thereof.

Figure 12:
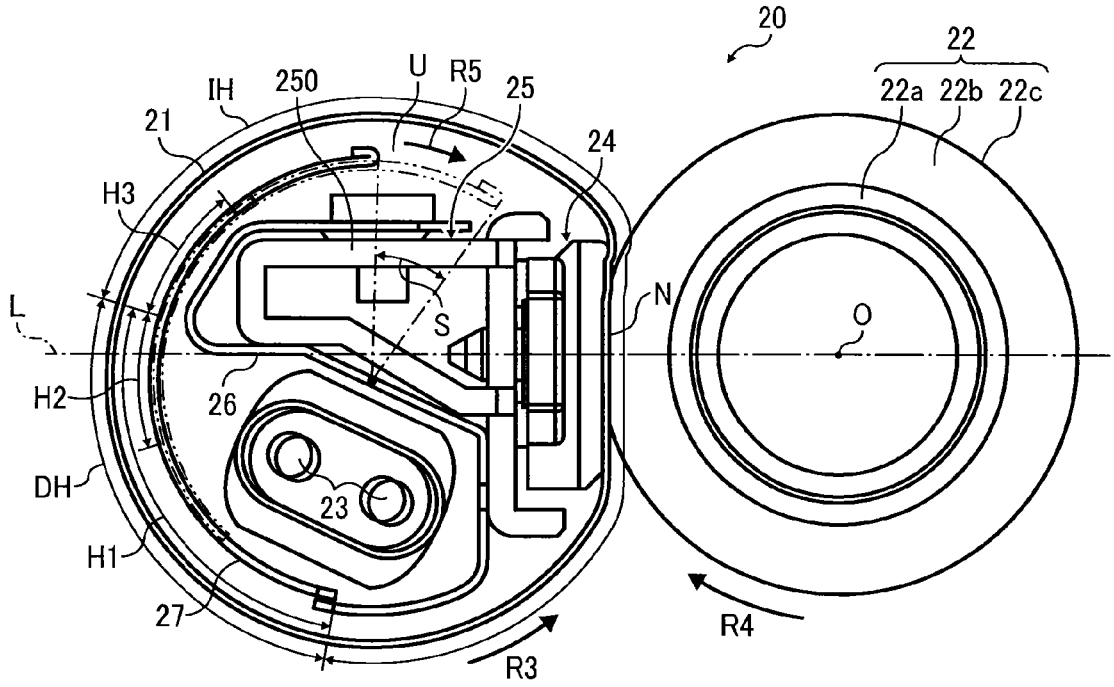
FIG. 12 is a vertical sectional view of the fixing device shown in FIG. 2 illustrating movement of the heat shield.

With reference to FIG. 12, a description is provided of a first example of the configuration to prevent thermal deformation of the heat shield 27 applied to the fixing device 20 incorporating the heat shield 27 including the shield portion 48 that creates a single step.

FIG. 12 is a vertical sectional view of the fixing device 20. As shown in FIG. 12, as the heat shield 27 moves from the shield position indicated by the solid line to the retracted position indicated by the chain double-dashed line, the heat shield 27 moves to a position behind the reflector 26 or the stay 25 where the heat shield 27 is disposed opposite the halogen heater pair 23 via the reflector 26 or the stay 25 and the indirect heating span IH of the fixing belt 21. For example, a direct opposing portion H1 of the heat shield 27 disposed opposite the halogen heater pair 23 directly at the shield position is partially behind the reflector 26 or the stay 25 at the retracted position. Specifically, an intermediate portion H2 of the direct opposing portion H1 of the heat shield 27 that is disposed opposite the halogen heater pair 23 directly at the shield position, after the heat shield 27 moves from the shield position to the retracted position, is at a circumferential span H3 behind the reflector 26 or the stay 25.

Thus, when the heat shield 27 is at the retracted position, the intermediate portion H2 of the direct opposing portion H1 of the heat shield 27 is at the position behind the reflector 26 or the stay 25 and therefore is disposed opposite the halogen heater pair 23 via the reflector 26 or the stay 25. Accordingly, the heat shield 27 escapes from light or heat radiated from the halogen heater pair 23, suppressing or preventing overheating and thermal deformation of the heat shield 27.

In order to increase the area of the heat shield 27 that escapes from light radiated from the halogen heater pair 23 when the heat shield 27 is at the retracted position, the heat shield 27 is requested to move in an increased circumferential moving span S. However, the nip formation assembly 24 situated inside the loop formed by the fixing belt 21 prohibits the heat shield 27 from moving toward the fixing nip N in a retract direction R5 counter to the rotation direction R3 of the fixing belt 21.

To address this circumstance, the halogen heater pair 23 is situated upstream from the fixing nip N in the rotation direction R3 of the fixing belt 21, that is, below the hypothetical line L in FIG. 12, so that the heat shield 27 is movable between the shield position indicated by the solid line where the heat shield 27 is situated at an upstream position upstream from the fixing nip N in the rotation direction R3 of the fixing belt 21 and the retracted position indicated by the chain double-dashed line where the heat shield 27 is situated at a downstream position downstream from the fixing nip N in the rotation direction R3 of the fixing belt 21. Accordingly, the heat shield 27 retracts to the downstream, retracted position where the nip formation assembly 24 does not interfere with movement of the heat shield 27 while increasing the circumferential moving span S of the heat shield 27 that moves in the circumferential direction of the fixing belt 21.

The stay 25 includes a downstream arm 250 extending from a position downstream from the nip formation assembly 24 in the rotation direction R3 of the fixing belt 21 leftward in FIG. 12 in a direction separating away from the pressing roller 22. A retract compartment U is interposed between the downstream arm 250 and the inner circumferential surface of the fixing belt 21 to accommodate the heat shield 27 at the retracted position. Since the stay 25 extends in the direction separating away from the pressing roller 22, the increased retract compartment U is secured in the limited space inside the loop formed by the fixing belt 21.

The increased retract compartment U and the increased circumferential moving span S increase the circumferential span of the heat shield 27 that escapes from light radiated from the halogen heater pair 23 when the heat shield 27 is at the retracted position, suppressing overheating of the heat shield 27. Such configuration to increase the circumferential moving span S of the heat shield 27 and the size of the retract compartment U is advantageous for the fixing device 20 incorporating the fixing belt 21 having a smaller diameter to reduce its thermal capacity because the smaller fixing belt 21 creates a smaller loop that accommodates a smaller interior space.

With reference to FIGS. 13A to 13D, 14A to 14D, and 15A to 15D, a description is provided of another example of the configuration to prevent thermal deformation of the heat shield 27S including the first shield section 48*b* and the second shield section 48*a* that create two steps.

Figure 13A:
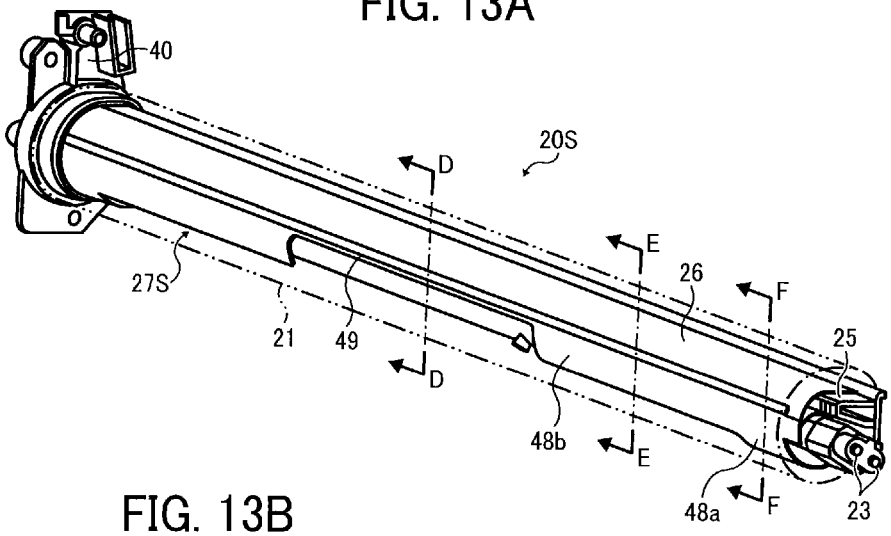
FIG. 13A is a partial perspective view of the fixing device shown in FIG. 10 illustrating the heat shield at a first shield position as a small recording medium is conveyed through a fixing nip.
Figure 13B:
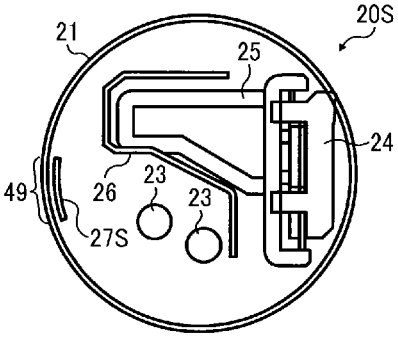
FIG. 13B is a partial vertical sectional view of the fixing device shown in FIG. 13A taken on the line D-D.
Figure 13C:
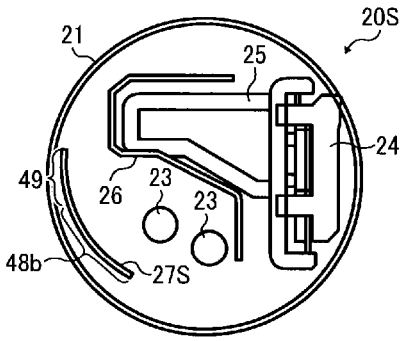
FIG. 13C is a partial vertical sectional view of the fixing device shown in FIG. 13A taken on the line E-E.
Figure 13D:
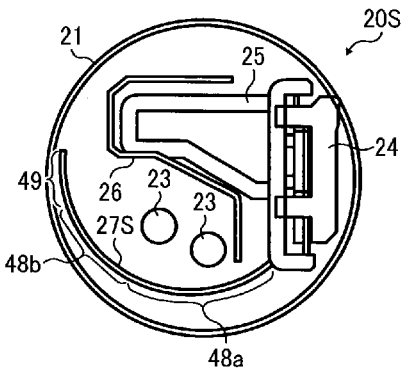
FIG. 13D is a partial vertical sectional view of the fixing device shown in FIG. 13A taken on the line F-F.
Figure 14A:
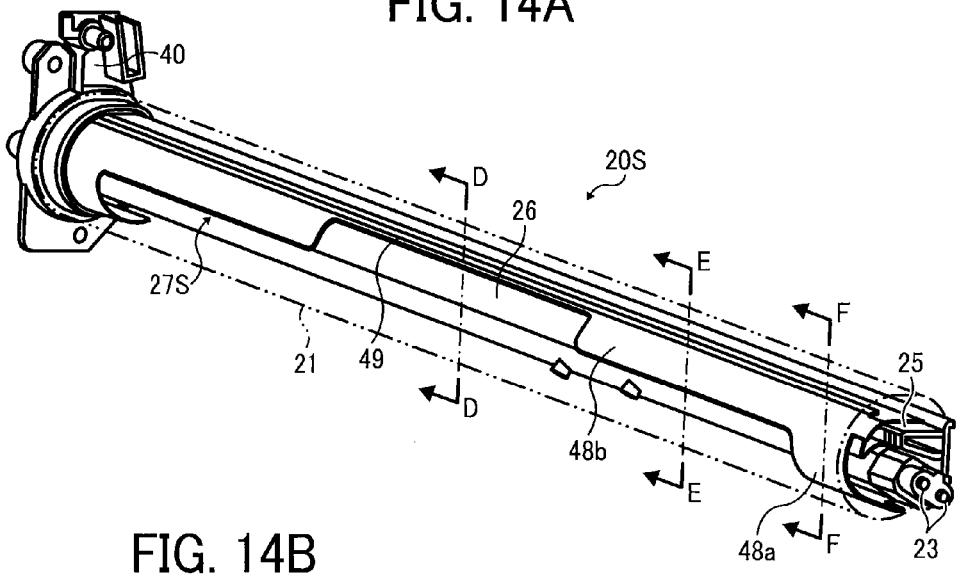
FIG. 14A is a partial perspective view of the fixing device shown in FIG. 10 illustrating the heat shield at a second shield position as a large recording medium is conveyed through the fixing nip.
Figure 14B:
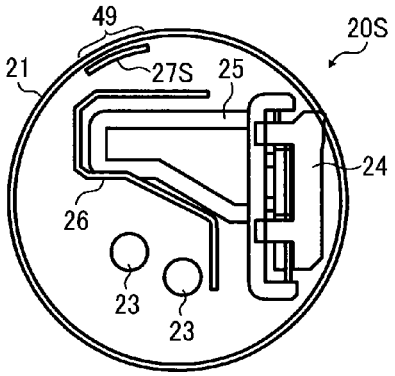
FIG. 14B is a partial vertical sectional view of the fixing device shown in FIG. 14A taken on the line D-D.
Figure 14C:
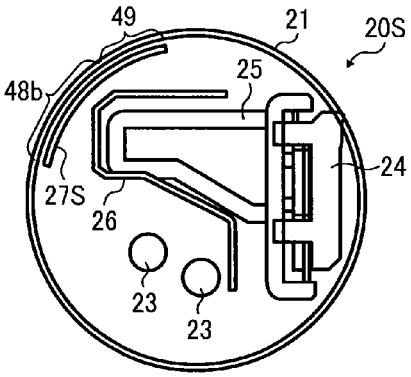
FIG. 14C is a partial vertical sectional view of the fixing device shown in FIG. 14A taken on the line E-E.
Figure 14D:
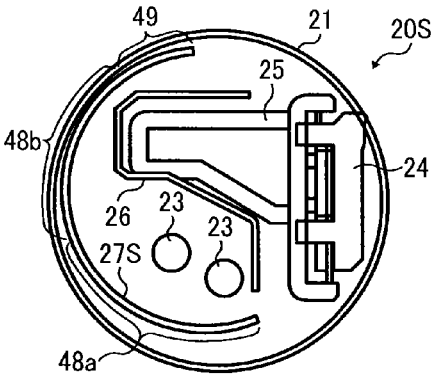
FIG. 14D is a partial vertical sectional view of the fixing device shown in FIG. 14A taken on the line F-F.
Figure 15A:
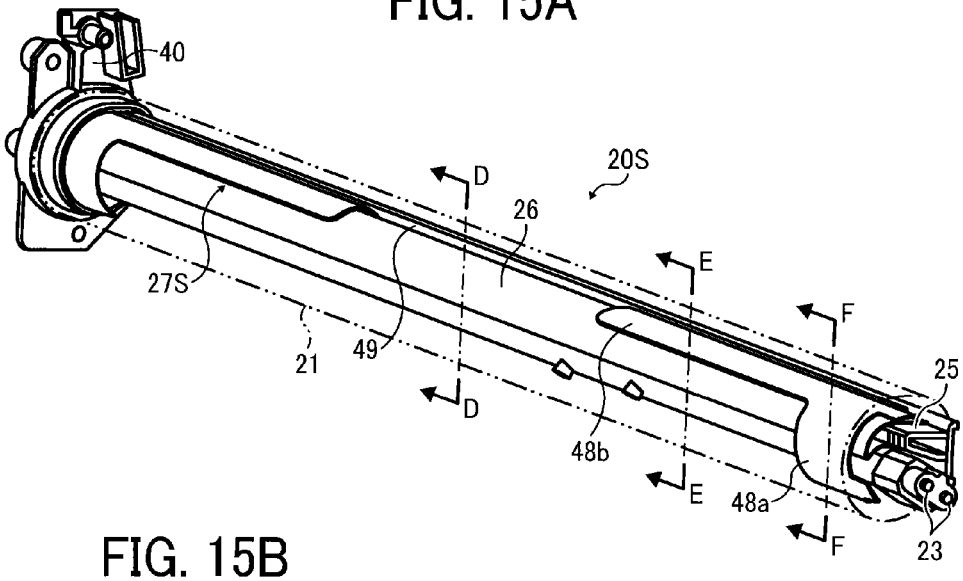
FIG. 15A is a partial perspective view of the fixing device shown in FIG. 10 illustrating the heat shield at the retracted position.
Figure 15B:
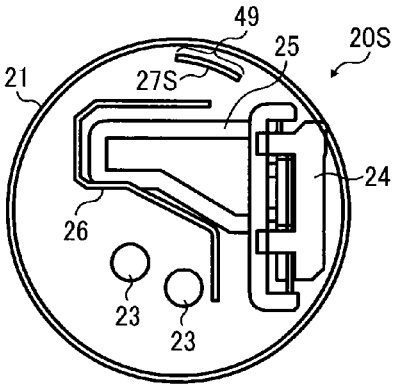
FIG. 15B is a partial vertical sectional view of the fixing device shown in FIG. 15A taken on the line D-D.
Figure 15C:
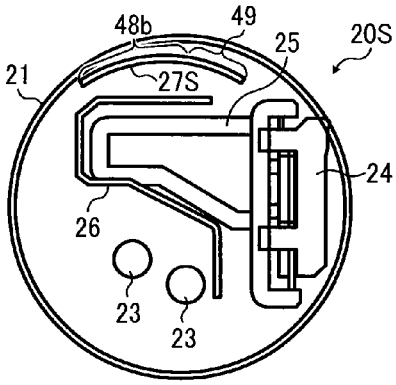
FIG. 15C is a partial vertical sectional view of the fixing device shown in FIG. 15A taken on the line E-E.
Figure 15D:
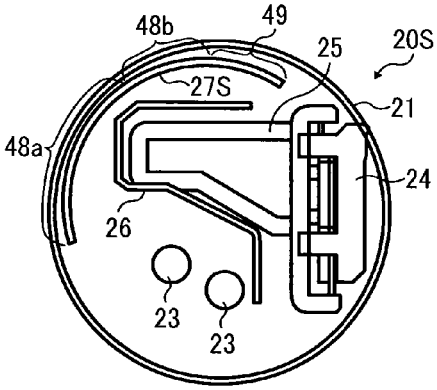
FIG. 15D is a partial vertical sectional view of the fixing device shown in FIG. 15A taken on the line F-F.

FIG. 13A is a partial perspective view of the fixing device 20S illustrating the heat shield 27S at a first shield position as a small recording medium P1 is conveyed through the fixing nip N. FIG. 13B is a partial vertical sectional view of the fixing device 20S taken on the line D-D in FIG. 13A. FIG. 13C is a partial vertical sectional view of the fixing device 20S taken on the line E-E in FIG. 13A. FIG. 13D is a partial vertical sectional view of the fixing device 20S taken on the line F-F in FIG. 13A. FIG. 14A is a partial perspective view of the fixing device 20S illustrating the heat shield 27S at a second shield position as a large recording medium P3 is conveyed through the fixing nip N. FIG. 14B is a partial vertical sectional view of the fixing device 20S taken on the line D-D in FIG. 14A. FIG. 14C is a partial vertical sectional view of the fixing device 20S taken on the line E-E in FIG. 14A. FIG. 14D is a partial vertical sectional view of the fixing device 20S taken on the line F-F in FIG. 14A. FIG. 15A is a partial perspective view of the fixing device 20S illustrating the heat shield 27S at the retracted position. FIG. 15B is a partial vertical sectional view of the fixing device 20S taken on the line D-D in FIG. 15A. FIG. 15C is a partial vertical sectional view of the fixing device 20S taken on the line E-E in FIG. 15A. FIG. 15D is a partial vertical sectional view of the fixing device 20S taken on the line F-F in FIG. 15A.

With reference to FIGS. 13A to 13D, a detailed description is now given of the first shield position of the heat shield 27S.

As the small recording medium P1 is conveyed through the fixing nip N, the heat shield 27S moves to the first shield position where the first shield sections 48*b* are disposed opposite the halogen heater pair 23 to shield the fixing belt 21 from the halogen heater pair 23. At the first shield position, the heat shield 27S is exposed to the halogen heater pair 23 in a maximum area thereof as shown in FIG. 13D.

With reference to FIGS. 14A to 14D, a detailed description is now given of the second shield position of the heat shield 27S.

As the large recording medium P3 is conveyed through the fixing nip N, the heat shield 27S moves to the second shield position where the first shield sections 48*b* are barely exposed to the halogen heater pair 23 and the second shield sections 48*a* are disposed opposite the halogen heater pair 23 to shield the fixing belt 21 from the halogen heater pair 23 as shown in FIG. 14D. For example, the heat shield 27S is less exposed to the halogen heater pair 23 at the second shield position shown in FIG. 14A than at the first shield position shown in FIG. 13A. Since a part of each first shield section 48*b* is behind the reflector 26 or the stay 25 as shown in FIG. 14D, the heat shield 27S is less heated by the halogen heater pair 23 at the second shield position than at the first shield position.

With reference to FIGS. 15A to 15D, a detailed description is now given of the retracted position of the heat shield 27S.

At the retracted position, the heat shield 27S is exposed to the halogen heater pair 23 in a minimum area thereof as shown in FIG. 15D. Like the heat shield 27 at the retracted position shown in FIG. 12, the heat shield 27S at the retracted position is situated behind the reflector 26 or the stay 25 in an increased area. Accordingly, the heat shield 27S escapes from light radiated from the halogen heater pair 23 in the increased area, suppressing overheating of the heat shield 27S. For example, as shown in FIG. 15C, the entire first shield section 48*b* having an increased width in the axial direction of the fixing belt 21 is behind the reflector 26 or the stay 25 and therefore escapes from light radiated from the halogen heater pair 23. That is, the reflector 26 or the stay 25 shields the entire first shield section 48*b* from the halogen heater pair 23, suppressing overheating of the heat shield 27S precisely.

The above describes the configuration and advantages of the heat shield 27 including the shield portion 48 that creates one step and the heat shield 27S including the shield portion 48S constructed of the first shield section 48*b* and the second shield section 48*a* that create two steps. Alternatively, the above-described configuration of the heat shields 27 and 27S may be applied to a heat shield including a shield portion that creates three or more steps. In this case also, the heat shield may be behind the reflector 26, the stay 25, or the like to escape from light radiated from the halogen heater pair 23, thus suppressing overheating of the heat shield.

Figure 16:
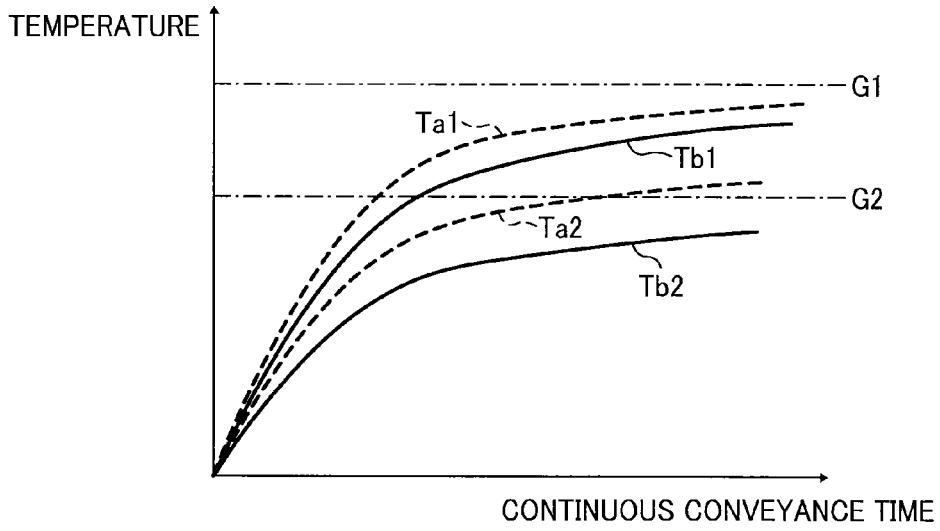
FIG. 16 is a graph showing a relation between a continuous conveyance time for conveying recording media through the fixing nip of the fixing devices shown in FIGS. 8 and 10 continuously and the temperature of a reflector, a heat shield having an increased thermal capacity, and a heat shield having a decreased thermal capacity.

With reference to FIG. 16, a description is provided of temperature increase of the reflector 26 and heat shields having a configuration equivalent to that of the heat shields 27 and 27S.

FIG. 16 is a graph showing a relation between a continuous conveyance time for conveying recording media through the fixing nip N continuously and the temperature of the reflector 26, a heat shield having an increased thermal capacity, and a heat shield having a decreased thermal capacity. In FIG. 16, a vertical axis represents the temperature of the reflector 26 and the heat shield. A horizontal axis represents the continuous conveyance time. A dotted curve Ta1 represents temperature increase of the heat shield having the decreased thermal capacity. A dotted curve Ta2 represents temperature increase of the reflector 26 with the heat shield having the decreased thermal capacity. A solid curve Tb1 represents temperature increase of the heat shield having the increased thermal capacity. A solid curve Tb2 represents temperature increase of the reflector 26 with the heat shield having the increased thermal capacity. An alternate long and short dashed curve G1 represents a heat resistant temperature of the heat shield. An alternate long and short dashed curve G2 represents a heat resistant temperature of the reflector 26.

As shown in FIG. 16, the temperature of the heat shield having the increased thermal capacity shown by the curve Tb1 increases more gently than the temperature of the heat shield having the decreased thermal capacity shown by the curve Ta1. That is, it takes longer for the heat shield having the increased thermal capacity to be heated to a heat resistant temperature. Hence, the heat shield having the increased thermal capacity is less susceptible to thermal deformation, allowing an increased number of recording media to pass through the fixing nip N continuously.

As shown in FIG. 16, the temperature of the reflector 26 increases more gently with the heat shield having the increased thermal capacity shown by the curve Tb2 than with the heat shield having the decreased thermal capacity shown by the curve Ta2. It is presumed that since the heat shield having the increased thermal capacity is capable of absorbing and storing an increased amount of heat, it draws the increased amount of heat from the surrounding components and therefore decreases an amount of heat to be conducted to the reflector 26. Thus, the heat shield having the increased thermal capacity absorbs the increased amount of heat, suppressing temperature increase of the surrounding components as a secondary advantage.

For example, the resin components (e.g., the flange 40 and the slider 41) have a heat resistant temperature of about 250 degrees centigrade lower than that of a metal component made of iron or the like and are subject to thermal damage. The reflector 26, made of a material and formed in a shape that have a decreased thermal capacity, is subject to temperature increase. Additionally, the reflector 26, situated in proximity to the halogen heater pair 23 and having a decreased heat resistant temperature of about 200 degrees centigrade, is subject to thermal damage more frequently than other components. To address this circumstance, the heat shield having the increased thermal capacity absorbs a part of heat to be conducted to the surrounding components including the reflector 26 and the resin components, thus suppressing or preventing temperature increase and resultant thermal damage and wear of the surrounding components. For example, in order to suppress temperature increase of the reflector 26 that is subject to thermal damage effectively, the thermal capacity of the heat shields 27 and 27S may be greater than that of the reflector 26.

In order to increase the thermal capacity of the heat shields 27 and 27S, the heat shields 27 and 27S are configured to be greater in axial width, circumferential length, or thickness. Alternatively, the heat shield 27 depicted in FIG. 8 may be modified into the heat shield 27S depicted in FIG. 10. For example, the heat shield 27S includes the shield portion 48S constructed of the first shield section 48*b* and the second shield section 48*a* that create the two steps, more than the single step created by the shield portion 48 of the heat shield 27, which increase the thermal capacity of the heat shield 27S. That is, by employing the heat shield 27S having the increased thermal capacity instead of the heat shield 27, the fixing device 20S prevents temperature increase of the heat shield 27S.

Figure 17:
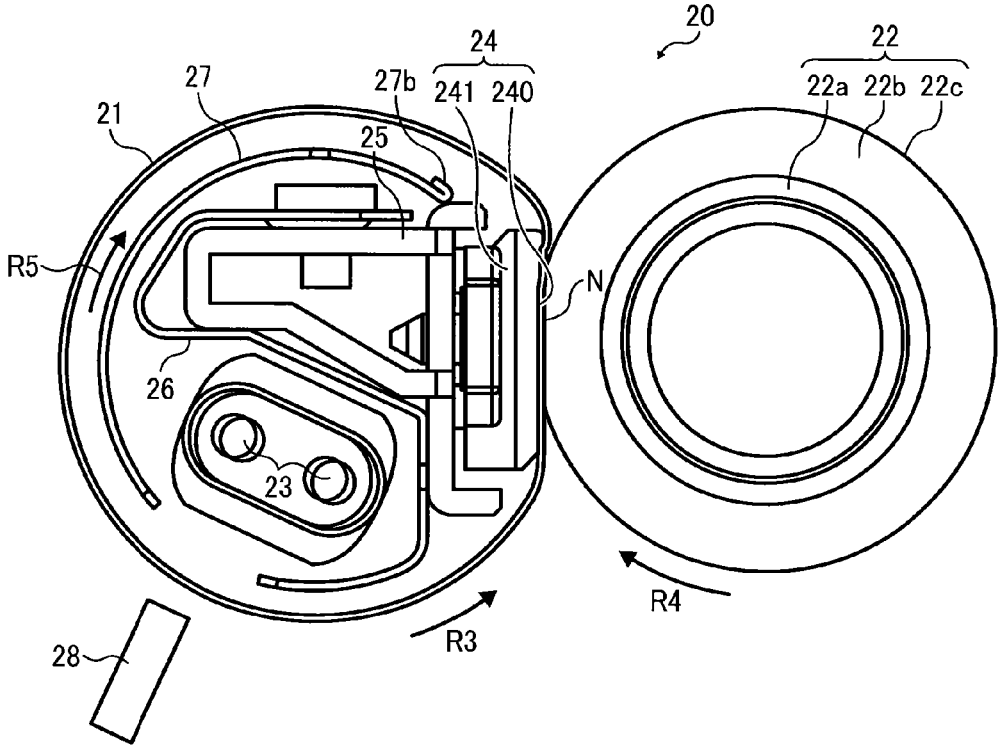
FIG. 17 is a vertical sectional view of the fixing device shown in FIG. 4 illustrating the heat shield contacting a stay.

With reference to FIG. 17, a description is provided of a second example of the configuration to prevent thermal deformation of the heat shields 27 and 27S.

FIG. 17 is a vertical sectional view of the fixing device 20 incorporating the heat shield 27. It is to be noted that the configuration shown in FIG. 17 is also applicable to the fixing device 20S depicted in FIG. 10. As shown in FIG. 17, as the heat shield 27 rotates in the retract direction R5 to the retracted position, a downstream, circumferential end 27*b* of the heat shield 27 comes into contact with the stay 25, dissipating heat stored in the heat shield 27 to the stay 25. Accordingly, the heat shield 27 suppresses temperature increase thereof, preventing thermal deformation of the heat shield 27 precisely. Further, as the heat shield 27 dissipates heat stored therein to the stay 25, the heat shield 27 absorbs heat from the surrounding components effectively, thus suppressing temperature increase of the surrounding components including the reflector 26 effectively.

Figure 18:
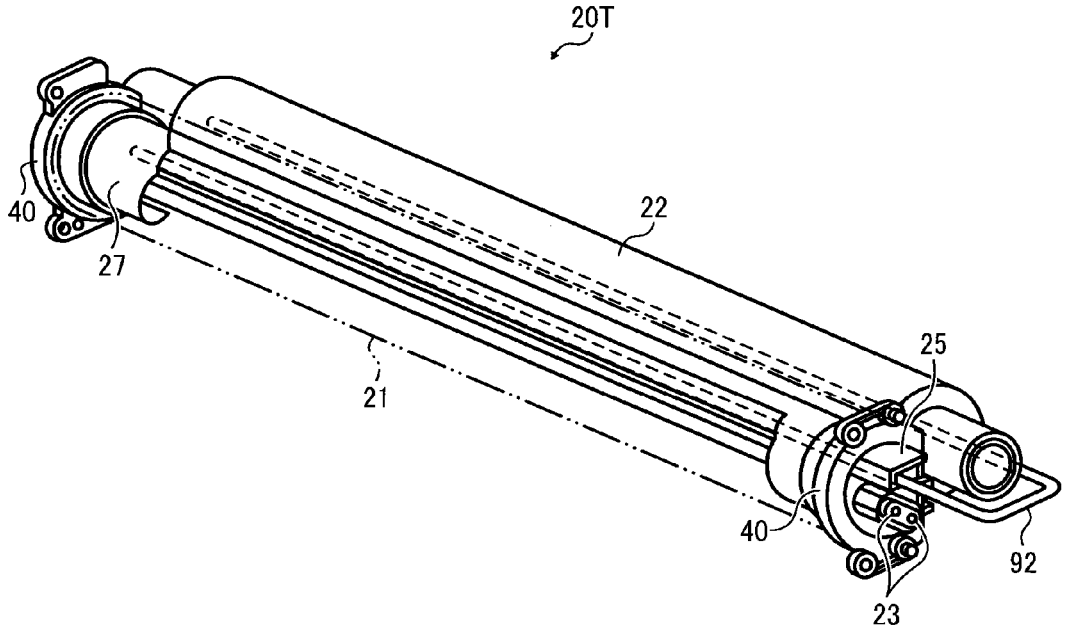
FIG. 18 is a perspective view of a fixing device according to yet another exemplary embodiment of the present invention.
Figure 19:
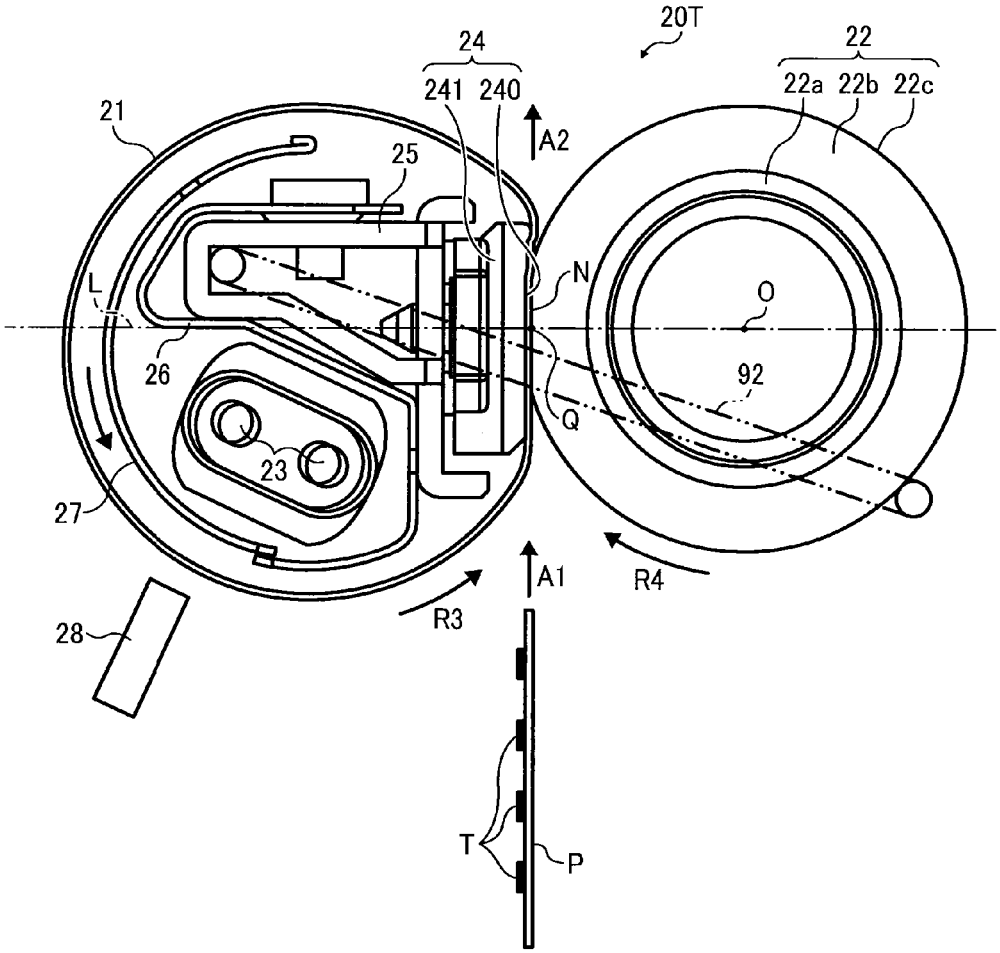
FIG. 19 is a vertical sectional view of the fixing device shown in FIG. 18.

With reference to FIGS. 18 and 19, a description is provided of a configuration of a fixing device 20T incorporating a thermal conductor 92.

FIG. 18 is a perspective view of the fixing device 20T. FIG. 19 is a vertical sectional view of the fixing device 20T. As shown in FIGS. 18 and 19, the thermal conductor 92 (e.g., a heat pipe) extends in the axial direction of the pressing roller 22 and contacts the stay 25 and the pressing roller 22 substantially throughout the entire width in the axial direction thereof, thus conducting heat received from the stay 25 to the pressing roller 22. Accordingly, heat stored in the stay 25 is used to heat or warm up the pressing roller 22 effectively, saving energy. According to this exemplary embodiment, the thermal conductor 92 contacts an outer circumferential surface of the pressing roller 22. Alternatively, the thermal conductor 92 may contact the metal core 22*a* depicted in FIG. 17 of the pressing roller 22.

Figure 20:
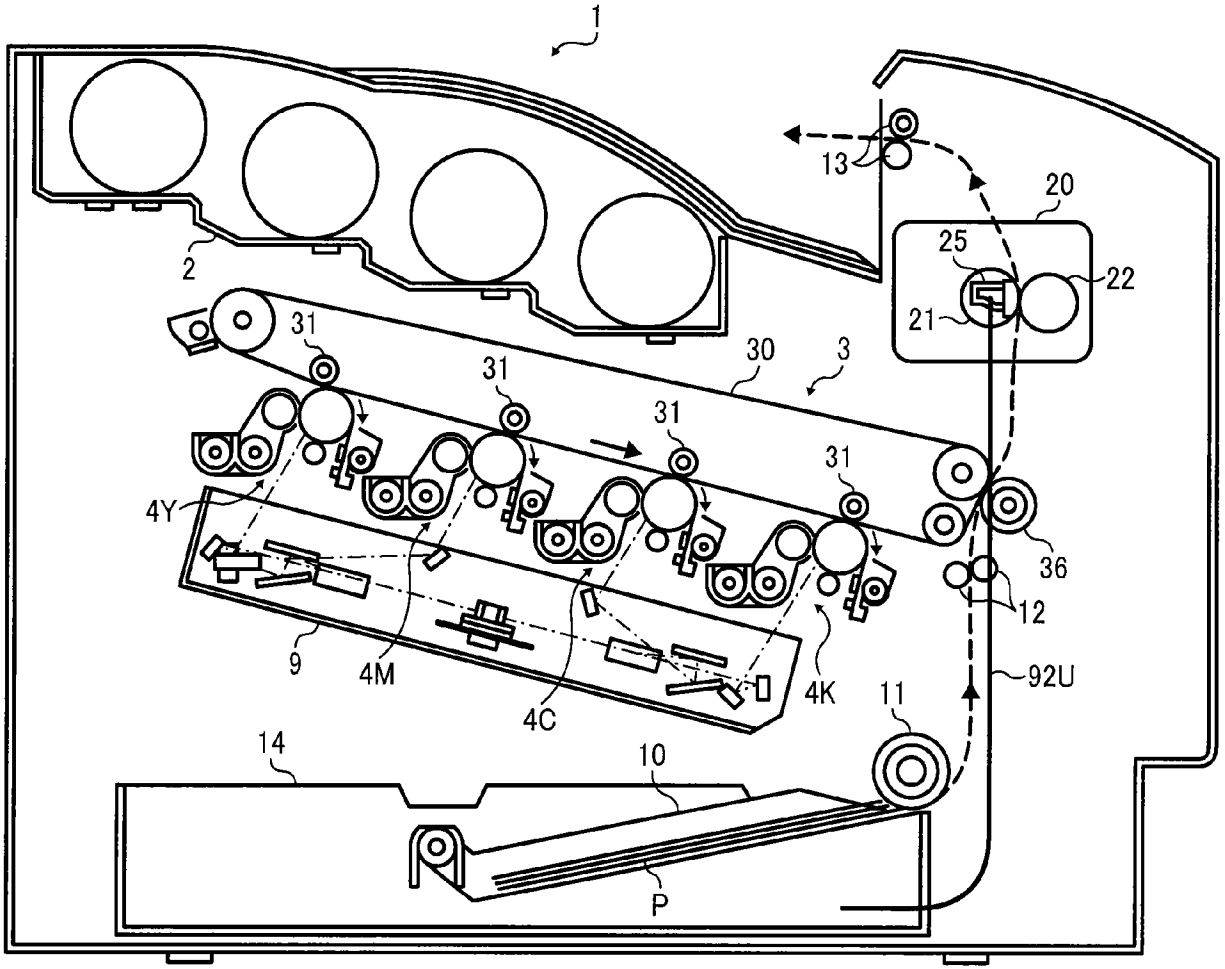
FIG. 20 is a schematic vertical sectional view of the image forming apparatus shown in FIG. 1 illustrating a thermal conductor incorporated therein.

With reference to FIG. 20, a description is provided of a configuration of a thermal conductor 92U incorporated in the image forming apparatus 1 as a variation of the thermal conductor 92 shown in FIGS. 18 and 19.

FIG. 20 is a schematic vertical sectional view of the image forming apparatus 1 incorporating the thermal conductor 92U. As shown in FIG. 20, the thermal conductor 92U extends from the stay 25 of the fixing device 20 to a sheet feeder 14 incorporating the paper tray 10 and contacts the stay 25 and the sheet feeder 14 to conduct heat received from the stay 25 to the sheet feeder 14. Accordingly, the sheet feeder 14 heated by the thermal conductor 92U warms up recording media P loaded on the paper tray 10, saving energy that may be used to heat the fixing device 20. Additionally, the thermal conductor 92U, by heating the recording media P, dries the recording media P and therefore prevents creasing and curl of the recording media P that may occur due to moisture absorption.

The above describes the exemplary embodiments that suppress overheating of the fixing belt 21 in view of heat resistance thereof. On the other hand, it is preferable to heat the fixing belt 21 first to improve fixing performance of the fixing device 20, that is, saving energy and shortening warm-up time taken to warm up the fixing belt 21 to a predetermined fixing temperature. For example, as the image forming apparatus 1 is powered on or as the fixing belt 21 is heated by the halogen heater pair 23 to the predetermined fixing temperature from a decreased temperature in a standby mode or a further decreased temperature in an energy saver mode, it is preferable that the components incorporated in the fixing device 20 are heated in decreasing order of contribution to improve fixing performance of the fixing device 20.

To address this circumstance, for example, the halogen heater pair 23, the fixing belt 21, the pressing roller 22, the nip formation assembly 24, the stay 25, and the heat shield 27 of the fixing device 20 shown in FIG. 2 are heated at the heating speeds defined by the formula (1) below, respectively, to heat the fixing belt 21 to the predetermined fixing temperature.

$$Vt1>Vt2>Vt3>Vt4>Vt5>Vt6 \quad (1)$$

In the formula (1), Vt1 represents a heating speed of the halogen heater pair 23. Vt2 represents a heating speed of the fixing belt 21. Vt3 represents a heating speed of the pressing roller 22. Vt4 represents a heating speed of the nip formation assembly 24. Vt5 represents a heating speed of the stay 25. Vt6 represents a heating speed of the heat shield 27.

In order to melt and fix the toner image T on the recording medium P, it is requested that at least the fixing belt 21 and the pressing roller 22 store an amount of heat great enough to melt the toner image T on the recording medium P. Hence, the fixing belt 21 and the pressing roller 22 are heated first. Conversely, heating of the nip formation assembly 24, the stay 25, and the heat shield 27 should be assigned lower priority compared to heating of the fixing belt 21 and the pressing roller 22. Accordingly, heat radiated from the halogen heater pair 23 is conducted such that the heating speed Vt2 of the fixing belt 21 and the heating speed Vt3 of the pressing roller 22 are higher than the heating speed Vt4 of the nip formation assembly 24, the heating speed Vt5 of the stay 25, and the heating speed Vt6 of the heat shield 27. With the configuration of the fixing device 20 depicted in FIG. 2, heat from the halogen heater pair 23 is conducted to the fixing belt 21 first. Then, a part of heat conducted to the fixing belt 21 is in turn conducted to the pressing roller 22. Hence, the heating speed Vt1 of the halogen heater pair 23 is higher than the heating speed Vt2 of the fixing belt 21; the heating speed Vt2 of the fixing belt 21 is higher than the heating speed Vt3 of the pressing roller 22.

Although the fixing belt 21 is in contact with the pressing roller 22 and the nip formation assembly 24, it is preferable that heat is conducted from the fixing belt 21 to the pressing roller 22 faster than the nip formation assembly 24 to improve fixing performance. That is, a thermal conductivity from the fixing belt 21 to the pressing roller 22 is greater than a thermal conductivity from the fixing belt 21 to the nip formation assembly 24.

However, a part of heat stored in the fixing belt 21 may be drawn to the nip formation assembly 24. To address this circumstance, the nip formation assembly 24 is heated faster than the stay 25 and the heat shield 27 so that the nip formation assembly 24 draws less heat from the fixing belt 21. That is, the heating speed Vt4 of the nip formation assembly 24 is higher than the heating speed Vt5 of the stay 25; the heating speed Vt5 of the stay 25 is higher than the heating speed Vt6 of the heat shield 27.

Since the stay 25 should not be heated fast, the stay 25 is spaced apart from the halogen heater pair 23 with an increased interval therebetween. As shown in FIG. 2, the reflector 26 interposed between the halogen heater pair 23 and the stay 25 reflects most of light radiated from the halogen heater pair 23 thereto to the fixing belt 21, suppressing conduction of heat from the halogen heater pair 23 to the stay 25. Further, if the reflector 26 is spaced apart from the stay 25 with an air layer therebetween, a decreased amount of heat is conducted from the reflector 26 to the stay 25. The heat shield 27 that should not be heated fast moves to the retracted position shown in FIG. 4 where the heat shield 27 is behind the reflector 26 and the stay 25 before the fixing belt 21 is heated to the predetermined fixing temperature. Accordingly, the heat shield 27 receives a decreased amount of heat from the halogen heater pair 23 and therefore increases an amount of heat to be conducted to the fixing belt 21.

If Vt7 representing a heating speed of the reflector 26 is added to the formula (1) above, the heating speed Vt7 is defined by the formula (2) below.

$$Vt1>Vt2>Vt7>Vt3>Vt4>Vt5>Vt6 \quad (2)$$

In order to reduce wasted energy, the reflector 26 is made of a material and a shape having a decreased thermal capacity. Accordingly, the reflector 26 is heated fast next to the fixing belt 21. That is, the heating speed Vt2 of the fixing belt 21 is higher than the heating speed Vt7 of the reflector 26.

After a plurality of recording media P is conveyed through the fixing nip N continuously for a long time, heat is conducted from the fixing belt 21 to the nip formation assembly 24 and from the halogen heater pair 23 to the reflector 26 and the stay 25. Thus, heat radiated from the halogen heater pair 23 is conducted to and stored in the components of the fixing device 20 gradually. Thereafter, the temperatures of the components of the fixing device 20 reach equilibrium. In order to achieve energy saving, an extended life, and an improved durability of the components of the fixing device 20 that keep their temperatures in equilibrium, the temperatures of the components in equilibrium are determined as below.

For example, the temperatures of the halogen heater pair 23, the fixing belt 21, the pressing roller 22, the nip formation assembly 24, and the stay 25 of the fixing device 20 shown in FIG. 2 in equilibrium are defined by the formula (3) below.

$$Et1>Et5>Et4>Et2>Et3 \quad (3)$$

In the formula (3), Et1 represents a temperature of the halogen heater pair 23. Et2 represents a temperature of the fixing belt 21. Et3 represents a temperature of the pressing roller 22. Et4 represents a temperature of the nip formation assembly 24. Et5 represents a temperature of the stay 25.

As shown in the formula (3), when the temperatures of the halogen heater pair 23, the fixing belt 21, the pressing roller 22, the nip formation assembly 24, and the stay 25 are in equilibrium, the temperature Et5 of the stay 25 is relatively high. Hence, the stay 25 stores an increased amount of heat, serving as a medium that conducts the stored heat to the fixing belt 21 and the like. Accordingly, the halogen heater pair 23 supplies an amount of heat per hour smaller than that supplied to warm up the fixing belt 21 but great enough to fix the toner image T on the recording medium P.

The temperature Et4 of the nip formation assembly 24 is relatively high next to the temperature Et5 of the stay 25, decreasing an amount of heat drawn from the fixing belt 21 to the nip formation assembly 24. Accordingly, fixing failure caused by temperature decrease of the fixing belt 21 at the fixing nip N is prevented.

However, if the nip formation assembly 24 is made of resin, the nip formation assembly 24 has a decreased heat resistance compared to the stay 25 made of metal. Hence, it is requested to prevent overheating of the nip formation assembly 24. For example, it is requested to prevent excessive thermal conduction from the stay 25 heated to a substantially high temperature to the nip formation assembly 24. To address this request, a thermal conductivity between the stay 25 and the nip formation assembly 24 is smaller than a thermal conductivity between the nip formation assembly 24 and the fixing belt 21. Accordingly, thermal conduction from the stay 25 to the nip formation assembly 24 is suppressed. Conversely, thermal conduction from the nip formation assembly 24 to the fixing belt 21 is facilitated, suppressing overheating of the nip formation assembly 24 and thereby preventing thermal wear and damage of the nip formation assembly 24.

If Et7 representing a temperature of the reflector 26 is added to the formula (3) above, the temperature Et7 is defined by the formula (4) below.

$$Et1>Et7>Et5>Et4>Et2>Et3 \quad (4)$$

That is, the temperature Et7 of the reflector 26 is relatively high next to the temperature Et1 of the halogen heater pair 23.

As described above with reference to FIG. 12, the heat shields 27 and 27S at the retracted position are behind the reflector 26 or the stay 25 and therefore are not exposed to the halogen heater pair 23, escaping from light radiated from the halogen heater pair 23 that may cause thermal deformation of the heat shields 27 and 27S. Accordingly, the heat shields 27 and 27S avoid degradation due to thermal deformation and interference with the surrounding components that may occur if the heat shields 27 and 27S suffer from thermal deformation, thus enhancing reliability of the fixing devices 20 and 20S.

According to the exemplary embodiments described above, the reflector 26 and the stay 25 serve as an overheating suppressor interposed between the halogen heater pair 23 and the heat shield (e.g., the heat shields 27 and 27S) to shield the heat shield from the halogen heater pair 23 and thereby suppress overheating of the heat shield. Alternatively, other components may serve as an overheating suppressor or a component dedicated to suppress overheating of the heat shield may be employed. If a crevice that shelters the heat shield is produced in the overheating suppressor, the heat shield may enter the crevice to escape from light radiated from the halogen heater pair 23. That is, the heat shield may be sheltered from the halogen heater pair 23 at positions other than a position behind the overheating suppressor and facing the inner circumferential surface of the fixing belt 21.

As shown in FIG. 2, the heat shield 27 may include an opposed face 27*a* disposed opposite the halogen heater pair 23. The opposed face 27*a* of the heat shield 27 may be treated with mirror finish. The mirror-finished opposed face 27*a* enhances the reflectance of light radiated from the halogen heater pair 23 thereto and suppresses overheating of the heat shield 27.

With reference to FIGS. 2, 4, 8, 10, and 12, a description is provided of advantages of the fixing devices 20, 20S, and 20T.

The fixing devices 20, 20S, and 20T include a fixing rotary body (e.g., the endless fixing belt 21) rotatable in the rotation direction R3; a heater (e.g., the halogen heater pair 23) to heat the fixing rotary body; the nip formation assembly 24 disposed inside the fixing rotary body; an opposed body (e.g., the pressing roller 22) pressed against the nip formation assembly 24 via the fixing rotary body to form a nip (e.g., the fixing nip N) between the opposed body and the fixing rotary body, through which a recording medium is conveyed; a heat shield (e.g., the heat shields 27 and 27S) to shield the fixing rotary body from the heater; and an overheating suppressor (e.g., the reflector 26 or the stay 25) interposed between the heater and the heat shield to shield the heat shield from the heater. The heat shield is interposed between the heater and the fixing rotary body. The heat shield is not circular in a circumferential direction of the fixing rotary body and extends substantially throughout the entire conveyance span on the fixing rotary body in an axial direction thereof where the recording medium is conveyed. The heat shield includes the intermediate portion H2 spanning in the circumferential direction of the fixing rotary body and movable between the shield position where the intermediate portion H2 is disposed opposite the heater directly and the retracted position where the intermediate portion H2 is disposed opposite the heater via the overheating suppressor.

When the heat shield is at the shield position, the intermediate portion H2 of the heat shield is disposed opposite the heater directly. Conversely, when the heat shield is at the retracted position, the intermediate portion H2 of the heat shield is disposed opposite the heater indirectly via the overheating suppressor. Accordingly, the overheating suppressor shields the heat shield from the heater, suppressing temperature increase of the heat shield.

As shown in FIGS. 8 and 10, the heat shield includes a shield portion (e.g., the shield portions 48 and 48S) disposed opposite a lateral end of the fixing rotary body in the axial direction thereof to shield the fixing rotary body from the heater. The heat shield further includes the recess 50 contiguous to the shield portion in the axial direction of the fixing rotary body.

The heat shield is movable to the shield position where the shield portion of the heat shield shields the fixing rotary body from the heater. For example, at the shield position, the shield portion of the heat shield is disposed opposite the non-conveyance span (e.g., the outboard spans S1a, S2a, and S3a) on the fixing rotary body where the recording medium is not conveyed. The non-conveyance span varies depending on the size of the recording medium. To address this circumstance, the heat shield moves or rotates according to the size of the recording medium, allowing the shield portion to shield the non-conveyance span on the fixing rotary body from the heater and thereby suppressing temperature increase of the fixing rotary body in the non-conveyance span thereof. Simultaneously, the recess 50 of the heat shield disposed opposite the conveyance span on the fixing rotary body where the recording medium is conveyed allows light radiated from the heater to irradiate the conveyance span on the fixing rotary body. Accordingly, the fixing devices 20, 20S, and 20T, with the heat shield, prevent overheating of the fixing rotary body in the non-conveyance span thereof without a plurality of heaters corresponding to a plurality of sizes of recording media.

According to the exemplary embodiments described above, the recording medium conveyed over the fixing belt 21 is centered in the axial direction thereof. Alternatively, the recording medium may be conveyed along one edge of the fixing belt 21 in the axial direction thereof. In this case, the heat shields 27 and 27S may include a single shield portion equivalent to the shield portion 48 or 48S that is disposed opposite one lateral end of the fixing belt 21 in the axial direction thereof.

According to the exemplary embodiments described above, the fixing belt 21 serves as a fixing rotary body. Alternatively, a fixing roller, a fixing film, or the like may be used as a fixing rotary body. The pressing roller 22 serves as an opposed body. Alternatively, a pressing belt, a pressing plate, a pressing pad, or the like may be used as an opposed body. Further, the shape of the heat shield is not limited to that of the heat shields 27 and 27S. For example, the heat shield may have three or more steps corresponding to the sizes of recording media available in the fixing device.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a fixing rotary body rotatable in a predetermined direction of rotation;

a heater disposed opposite and heating the fixing rotary body;

an opposed body contacting the fixing rotary body to form a nip therebetween through which a recording medium is conveyed;

a heat shield movable in a circumferential direction of the fixing rotary body and interposed between the heater and the fixing rotary body to shield the fixing rotary body from the heater, the heat shield not circular in the circumferential direction of the fixing rotary body and extending substantially throughout a conveyance span of the fixing rotary body in an axial direction thereof where the recording medium is conveyed; and an overheating suppressor interposed between the heater and the heat shield to shield the heat shield from the heater, the heat shield including an intermediate portion spanning in the circumferential direction of the fixing rotary body and movable between a shield position where the intermediate portion is disposed opposite the heater directly and a retracted position where the intermediate portion is disposed opposite the heater via the overheating suppressor.

2. The fixing device according to claim 1, wherein the heater is disposed inside the fixing rotary body and upstream from the nip in the direction of rotation of the fixing rotary body and the overheating suppressor is disposed inside the fixing rotary body and downstream from the nip in the direction of rotation of the fixing rotary body.

3. The fixing device according to claim 1, further comprising:

a nip formation assembly disposed inside the fixing rotary body and pressing against the opposed body via the fixing rotary body; and a support contacting and supporting the nip formation assembly, wherein the overheating suppressor includes the support.

4. The fixing device according to claim 3, further comprising a retract compartment disposed downstream from the nip formation assembly in the direction of rotation of the fixing rotary body, wherein the support includes a downstream arm extending from a position downstream from the nip formation assembly in the direction of rotation of the fixing rotary body in a direction separating away from the opposed body, and wherein the retract compartment is interposed between the downstream arm and an inner circumferential surface of the fixing rotary body and accommodates the heat shield when the heat shield is at the retracted position.

5. The fixing device according to claim 1, wherein the heat shield further includes a shield portion disposed opposite a lateral end of the fixing rotary body in the axial direction thereof, the shield portion including:

a first shield section having a first axial length in the axial direction of the fixing rotary body; and a second shield section contiguous to the first shield section and having a second axial length in the axial direction of the fixing rotary body that is smaller than the first axial length of the first shield section, and wherein at least the first shield section is disposed opposite the heater via the overheating suppressor when the heat shield is at the retracted position.

6. The fixing device according to claim 1, wherein the heat shield further includes an opposed face disposed opposite the heater and treated with mirror finish.

7. The fixing device according to claim 1, further comprising a reflector disposed opposite the heater to reflect light radiated from the heater thereto toward the fixing rotary body, wherein the overheating suppressor includes the reflector.

8. The fixing device according to claim 1, further comprising a reflector disposed opposite the heater to reflect light radiated from the heater thereto toward the fixing rotary body, wherein a thermal capacity of the heat shield is greater than a thermal capacity of the reflector.

9. The fixing device according to claim 8, wherein the heat shield further includes a circumferential end that comes into contact with the overheating suppressor when the heat shield moves to the retracted position.

10. The fixing device according to claim 9, further comprising a thermal conductor contacting the overheating suppressor and the opposed body to conduct heat received from the overheating suppressor to the opposed body.

11. The fixing device according to claim 1, further comprising:

a nip formation assembly disposed inside the fixing rotary body and pressing against the opposed body via the fixing rotary body; and a support contacting and supporting the nip formation assembly, wherein heating speeds of the heater, the fixing rotary body, the opposed body, the nip formation assembly, the support, and the heat shield at which the fixing rotary body is heated to a predetermined temperature satisfy a following formula:

$$Vt1>Vt2>Vt3>Vt4>Vt5>Vt6$$

where Vt1 represents a heating speed of the heater, Vt2 represents a heating speed of the fixing rotary body, Vt3 represents a heating speed of the opposed body, Vt4 represents a heating speed of the nip formation assembly, Vt5 represents a heating speed of the support, and Vt6 represents a heating speed of the heat shield.

12. The fixing device according to claim 11, further comprising a reflector disposed opposite the heater to reflect light radiated from the heater thereto toward the fixing rotary body, wherein a heating speed Vt7 of the reflector at which the fixing rotary body is heated to the predetermined temperature is lower than the heating speed Vt2 of the fixing rotary body and higher than the heating speed Vt3 of the opposed body.

13. A fixing device comprising:

a fixing rotary body rotatable in a predetermined direction of rotation;

a heater disposed opposite and heating the fixing rotary body;

an opposed body contacting the fixing rotary body to form a nip therebetween through which a recording medium is conveyed; and a heat shield movable in a circumferential direction of the fixing rotary body and interposed between the heater and the fixing rotary body to shield the fixing rotary body from the heater, the heat shield including:

a primary shield portion disposed opposite a lateral end of the fixing rotary body in an axial direction thereof to shield the fixing rotary body from the heater; and a recess defined by the primary shield portion in the axial direction of the fixing rotary body to allow light radiated from the heater to irradiate the fixing rotary body.

14. The fixing device according to claim 13, wherein the primary shield portion of the heat shield includes an axially straight edge situated at one end of the primary shield portion in the circumferential direction of the fixing rotary body and extending in the axial direction of the fixing rotary body.

15. The fixing device according to claim 13, wherein the primary shield portion of the heat shield includes a sloped edge situated at one end of the primary shield portion in the axial direction of the fixing rotary body and angled relative to the circumferential direction of the fixing rotary body.

16. The fixing device according to claim 15, wherein the sloped edge of the primary shield portion of the heat shield overlaps a side edge of the recording medium in the axial direction of the fixing rotary body as the recording medium is conveyed over the fixing rotary body.

17. The fixing device according to claim 13, wherein the heat shield further includes:

a secondary shield portion disposed opposite another lateral end of the fixing rotary body in the axial direction thereof to shield the fixing rotary body from the heater, the secondary shield portion spaced apart from the primary shield portion in the axial direction of the fixing rotary body; and a bridge bridging the primary shield portion and the secondary shield portion in the axial direction of the fixing rotary body.

18. The fixing device according to claim 17, wherein the bridge includes an inner edge disposed at one end thereof in the circumferential direction of the fixing rotary body and extending in the axial direction of the fixing rotary body, wherein each of the primary shield portion and the secondary shield portion includes:

a first shield section contiguous to the bridge in the axial direction of the fixing rotary body and including a first inboard edge contiguous to and angled relative to the inner edge of the bridge; and a second shield section contiguous to and disposed outboard from the first shield section in the axial direction of the fixing rotary body and including a second inboard edge contiguous to and angled relative to the first inboard edge of the first shield section, and wherein the recess is enclosed by the inner edge of the bridge and the first inboard edge and the second inboard edge of each of the primary shield portion and the secondary shield portion.

19. The fixing device according to claim 13, wherein the fixing rotary body includes:

a circumferential, direct heating span where the heater is disposed opposite and heats the fixing rotary body directly; and a circumferential, indirect heating span where the heater is disposed opposite the fixing rotary body indirectly, and wherein the heat shield is movable between a shield position where the heat shield is substantially disposed opposite the direct heating span of the fixing rotary body and a retracted position where the heat shield is substantially disposed opposite the indirect heating span of the fixing rotary body.

20. An image forming apparatus comprising the fixing device according to claim 1.

21. The fixing device according to claim 1, wherein:

at least part of the heater is disposed opposite the fixing rotary body to directly heat the fixing rotary body with radiation heat.

22. The fixing device according to claim 2, further comprising:

a nip formation assembly disposed inside the fixing rotary body and pressing against the opposed body via the fixing rotary body; and a support contacting and supporting the nip formation assembly, wherein the overheating suppressor includes the support.

23. The fixing device according to claim 4, wherein:

the support includes two arms extending towards a region where the opposed body contacts the fixing rotary body.

* * * * *